US007431888B2

(12) United States Patent
Frechet et al.

(10) Patent No.: US 7,431,888 B2
(45) Date of Patent: Oct. 7, 2008

(54) PHOTOINITIATED GRAFTING OF POROUS POLYMER MONOLITHS AND THERMOPLASTIC POLYMERS FOR MICROFLUIDIC DEVICES

(75) Inventors: Jean M. J. Frechet, Oakland, CA (US); Frantisek Svec, Alameda, CA (US); Thomas Rohr, Leiden (NL)

(73) Assignee: The Regents of the University of California, Oakland, CA (US)

( * ) Notice: Subject to any disclaimer, the term of this patent is extended or adjusted under 35 U.S.C. 154(b) by 695 days.

(21) Appl. No.: 10/665,900

(22) Filed: Sep. 19, 2003

(65) Prior Publication Data

US 2004/0101442 A1 May 27, 2004

Related U.S. Application Data

(60) Provisional application No. 60/412,419, filed on Sep. 20, 2002.

(51) Int. Cl.
*B01L 3/02* (2006.01)

(52) U.S. Cl. ..... 422/100; 204/454; 422/99; 436/180

(58) Field of Classification Search ..... 422/99–101; 435/2; 204/61, 454; 436/180
See application file for complete search history.

(56) References Cited

U.S. PATENT DOCUMENTS 5,316,680 A 5/1994 Fréchet et al.
5,334,310 A 8/1994 Fréchet et al.
5,431,807 A 7/1995 Fréchet et al.
5,453,185 A 9/1995 Fréchet et al.
5,522,994 A 6/1996 Fréchet et al.
5,547,575 A 8/1996 Demmer et al.
5,633,290 A 5/1997 Fréchet et al.
5,728,457 A 3/1998 Fréchet et al.
5,744,250 A 4/1998 Lee et al.
5,786,428 A 7/1998 Arnold et al.
5,929,214 A 7/1999 Fréchet et al.
6,013,855 A 1/2000 McPherson et al.
6,306,273 B1 10/2001 Wainwright et al.
6,358,557 B1 3/2002 Wang et al.
6,361,958 B1 3/2002 Shieh et al.
6,384,100 B1 5/2002 Choi
2001/0007701 A1 7/2001 Karger et al.
2002/0125135 A1 * 9/2002 Derand et al. ..... 204/454

OTHER PUBLICATIONS

Allmer K, Hult A, Ranby B., Surface modification of polymers. II: Grafting with glycidyl acrylate and the reactions of the grafted surface with amines. *J. Polym Sci Polym Chem* 1989; 27:1641-52.

(Continued)

*Primary Examiner*—Jill Warden
*Assistant Examiner*—Jyoti Nagpaul
(74) *Attorney, Agent, or Firm*—Lawrence Berkeley National Laboratory; Michelle Chew Wong

(57) ABSTRACT

A microfluidic device preferably made of a thermoplastic polymer that includes a channel or a multiplicity of channels whose surfaces are modified by photografting. The device further includes a porous polymer monolith prepared via UV initiated polymerization within the channel, and functionalization of the pore surface of the monolith using photografting. Processes for making such surface modifications of thermoplastic polymers and porous polymer monoliths are set forth.

20 Claims, 7 Drawing Sheets

OTHER PUBLICATIONS

Allmer K, Hult A, Ranby B., Surface modification of polymers. III: Grafting of Stabilizers onto Polymer Films. *J. Polym Sci Polym Chem* 1989; 27:3405-13.

Ang Ch, Garnett JL, Levot RG, Long Ma. The effect of Additives for accelerating radiation grafting. The use of the technique for modification of polymers especially polyolefins. In: Carraher Jr CE, Moore JA, editors. *Modification of polymers*. New York: Plenum Press, 1983. p. 33-53.

Auroux P.A., Iossifidis D., Reyes D.R., Manz A., "Mirco Total Analysis Systems. 2. Analytical Standard Operations and Applications," *Anal. Chem*. 2002, 74, 2637.

Barkers S. L. R., Tarlov MJ, Canavan H, Hickman JJ, and Locascio LE, "Plastic Microfluidic Devices Modified with Polyelectrolyte Multilayers", *Anal. Chem*.; 2000; 72(20) pp. 4899-4903.

Berman, et al., "Total Alignment of Calcite at Acidic Polydiacetylene Films: Cooperativity at the Organic-Inorganic Interface," *Science*, vol. 269, pp. 515-518, (Jul. 28, 1995).

Chan C.M., Ko T.M., Hiraoka H., "Polymer Surface modification by plasmas and photons," *Surf. Sci. Rep*. 1996, 24, 3.

Chen, W. And McCarthy, TJ, "Layer-by-Layer Deposition: A Tool for Polymer Surface Modification," *Macromolecules* 1997, 30, 78-86, Jan. 13, 1997.

Chiari M, Cretich M, Stastna M, Radko SP, Chrambach A, "Rapid capillary coating by epoxy-poly-(dimethylacrylamide): Performance in capillary zone electrophoresis of protein and polystyrene carboxylate," *Electrophoresis*. 2001;22(4):656-9.

Eckert AW, Grobe D, Rothe U., Surface-modification of polystyrene-microtitre plates via grafting of glycidytmethacrylate and coating of poly-glycidylmethacrylate, *Biomaterials*. Mar. 2000;21(5):441-7.

Henry A.C., Tutt T.J., Galloway M., Davidson Y.Y., McWhorter C.S., Soper S.A., McCarley R.L., "Surface Modification of Poly(methyl methacrylate) Used in the Fabrication of Microanalytical Devices," *Anal. Chem*. Nov. 1, 2000, 72, 5331.

Hu, S. et al., "Surface Modification of Poly(dimethylsiloxane) Microfluidic Devices by Ultraviolet Polymer Grafting," Anal. Chem., 74, 4117-4123, Jun. 6, 2002.

Kamath KR, Park K., "Surface modification of polymeric biomaterials by albumin grafting using n-irradiation," *J Appl Biomater*. 1994 Summer;5(2):163-73.

Kato, K., Uchida, E., Kang, E. T., Uyama, Y., & Ikada, Y. "Polymer surface with graft chains," *Progress in Polymer Science*, 28(2): 209-259, 2003.

Liston E., Martinu L., Wertheimer M., "Plasma Surface Modification of polymers for improved adhesion: a critical review," *J. Adhes. Sci. Technol*. 1993, 7, 1091.

Ma Z, Gao C, Shen J, "Surface modification of poly-L-lactic acid (PLLA) membrane by grafting acrylamide: an effective way to improve cytocompatibility for chondrocytes," *J Biomater Sci Polym Ed*. 2003;14(1):13-25.

Meyer, U., Svec, F., and Frechet, JMJ, "Use of Stable Free Radicals for the Sequential Preparation and Surface Grafting of Functionalized Macroporous Monoliths," *Macromolecules* 2000, 33, 7769-7775, Sep. 28, 2000.

Nakayama Y, Matsuda T, Irie M., "A novel surface photo-graft polymerization method for fabricated devices," *ASAIO J*. Jul.-Sep. 1993;39(3):M542-4.

Oster G., Shibata O., "Graft Copolymer of Polyacrylamide and Natural Rubber Produced by Means of Ultaviolet Light," *J. Polym. Sci*. 1957, 26, 233-234.

Peters, EC, Svec, F, and Frechet JMJ, "Control of Porous Properties and Surface Chemistry in "Molded" Porous Polymer Monoliths Prepared by Polymerization in the Presence of Tempo," *Macromolecules* 1999, 32, 6377-6379, Aug. 19, 1999.

Peterson, H., et al., "Poly(ethylenimine-*co*-L-lactamide-*co*-succinamide): A Biodegradable Polyethylenimine Derivative with an Advantageous pH-Dependent Hydrolytic Degradation for Gene Delivery," *Bioconjugate Chem*. 2002, 13, 812-821, Jun. 1, 2002.

Qin D., Xia Y.N., Rogers J.A., Jackman R.J., Zhao X.M., Whitesides G.M., "Microfabrication, Microstructures and Microsystems," *Top. Curr. Chem*. 1998, 194, 1-20.

RÅnby B., "Surface Modification of Polymers by Photoinitiated Graft Polymerization," *Makromol. Chem. , Macromol. Symp*. 1992,63, 55.

RÅnby B., Yang W.T., Tretinnikov O., "Surface photografting of polymer fibers, films and sheets," *Nucl. Instrum. Methods Phys. Res., Sect. B* 1999,151, 301-305.

Reyes D.R., Iossifidis D., Auroux P.A., Manz A., "Micro Total Analysis Systems. 1. Introduction, Theory, and Technology," *Anal. Chem*. 2002, 74, 2623.

Rohr T., Yu C., Davey M.H., Svec F., Fréchet J.M.J., "Porous polymer monomliths: Simple and efficient mixers prepared by direct polymerization in the channels of microfluidic chips," *Electrophoresis* 2001, 22, 3959.

Shin DS, Lee KN, Jang KH, Kim JK, Chung WJ, Kim YK and Lee YS, "Protein pattering by maskless photolithography on hydrophilic polymer-grafted surface," *Biosensors and Bioelectronics*, vol. 19, Issue 5, Dec. 30, 2003, pp. 485-494.

Schweitz, L, Andersson, L.I., and Nilsson, S., "Rapid electrochromatographic enantiomer separations on short molecularly imprinted polymer monoliths," *Analytica Chimica Acta* 435 (2001) 43-47.

Stachowiak TB, Rohr T, Hilder EF, Peterson DS, Yi M, Svec F, Frechet JM, "Fabrication of porous polymer monoliths covalently attached to the walls of channels in plastic microdevices," *Electrophoresis*. Nov. 2003;24(21):3689-93.

Svec, F.; Fréchet, J. M. J., "Continuous Rods of Macroporous Polymer as High Performance Liquid Chromatography Separation Media," *Anal. Chem*. 1992, 54, 820.

Svec, F.; Fréchet, J. M. J., "New Designs of Macroporous Polymers and Supports: From Separation to Biocatalysis," *Science* 1996, 273, 205.

Svec F., Yu C., Rohr T., Fréchet J.M.J., In *Micro Total Analysis Systems 2001*, Ramsey J.M., van den Berg A. (Eds.), Kluwer Acad. Publ., Dordrecht, 2001, p. 643-645.

Svec F., Fréchet J.M.J., Hilder E.F., Peterson D.S., Rohr T., In *Micro Total Analysis Systems 2002*, Baba Y., van den Berg A. (Eds.), Kluwer Academic Publishers, Dordrecht, 2002, p. 332-334.

Throckmorton DJ, Shepodd TJ, and Singh AK, "Electrochromatography in Microchips: Reversed-Phase Separation of Peptides and Amino Acids Using Photopatterned Rigid Polymer Monoliths," *Anal. Chem*.; Feb. 15, 2002; 74(4) pp. 784-789.

Uyama, Y., Kato K., Ikada Y., "Surface Modification of Polymers by Grafting," *Adv. Polym. Sci*. 1998, 137, 1.

Viklund, C.; Ponten, E.; Glad, B.; Irgum, K.; Horstedt, P.; Svec, F.; ""Molded" Macroporous Poly(glycidyl methacrylate-*co*-trimethylolpropane trimethacrylate) Materials with Fine Controlled Porous Properties: Preparation of Monoliths Using Photoinitiated Polymerization," *Chem. Mater*.; (Article); Feb. 1997; 9(2): 463-471.

Viklund, C.; Svec F, Fréchet J. M. J., and Irgum K, "Fast Ion-Exchange HPLC of Proteins Using Porous Poly(glycidyl methacrylate-*co*-ethylene dimethacrylate) Monoliths Grafted with Poly(2-acrylamido-2-methyl-1-propanesulfonic acid)," *Biotechnol. Prog*.; 1997; 13(5) pp. 597-600.

Viklund, C and Irgum, K., Synthesis of Porous Zwitterionic Sulfobetaine Monoliths and Characterization of Their Interaction with Proteins, *Macromolecules*, 33, 2539-2544, Mar. 11, 2000.

Wang B, Abdulali-Kanji Z, Dodwell E, Horton JH, Oleschuk RD, "Surface characterization using chemical force microscopy and the flow performance of modified polydimethylsiloxane for microfluidic device applications," *Electrophoresis*, vol. 24, Issue 9, 2003, p. 1442-1450.

Xie S, Svec F, Frechet JM., * *"Design of reactive porous polymer supports for high throughput bioreactors: poly(2-vinyl-4,4-dimethylazlactone-co-acrylamine- co-ethylene dimethacrylate) monoliths," *Biotechnol Bioeng*. Jan. 5, 1999;62(1):30-5.

Yu C., Svec F., Fréchet J.M.J., "Toward stationary phases for chromatography on a microchip: Molded porous polymer monoliths prepared in capillaries by photoinitiated in situ polymerization as separation media for electrochromatography," *Electrophoresis* 2000, 21, 120.

Yu C., Davey M.H., Svec F., Fréchet J.M.J., "Monolithic Porous Polymer for On-Chip Solid-Phase Extraction and Preconcentration Prepared by Photoinitiated in Situ Polymerization within a Microfluidic Device," *Anal. Chem*. 2001, 73, 5088.
Yu C., Xu M., Svec F., Fréchet J.M.J. "Preparation of monolithic polymers with controlled porous properties for microfluidic chip applications using photoinitiated free-radical polymerization," *J. Polym. Sci., Polym. Chem*. 2002, 40, 755.

* cited by examiner

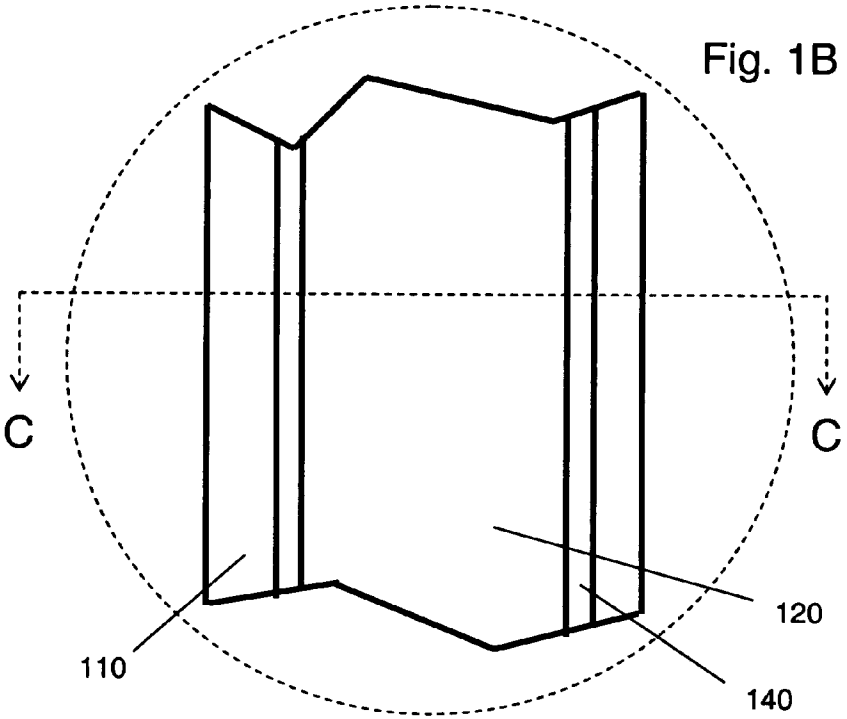
Fig. 1B
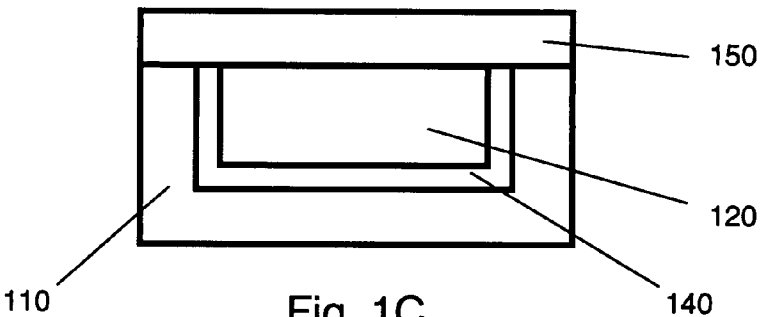
Fig. 1C
Figure 1
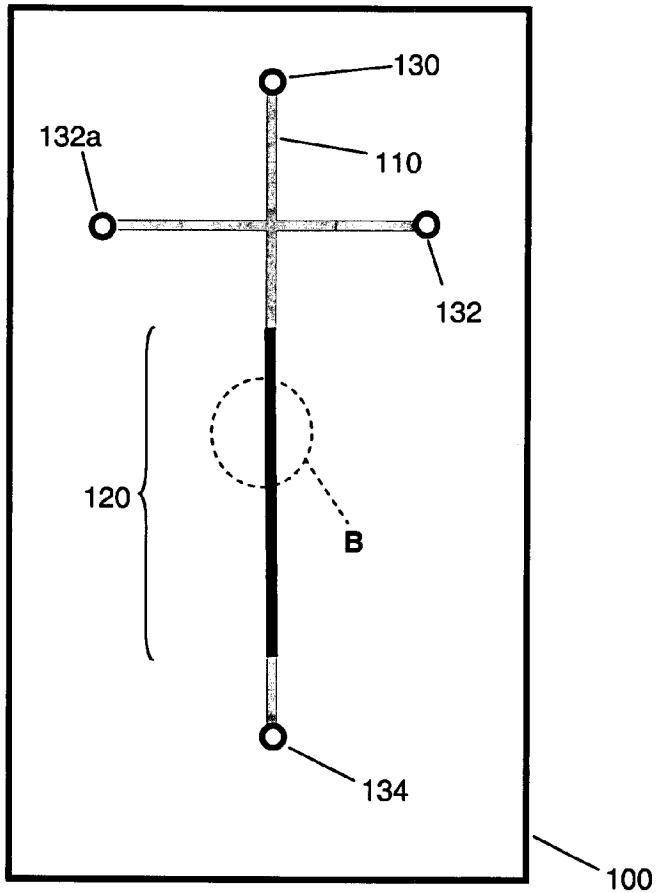
Fig. 1A

A = AMPS
B = BuA

PHOTOINITIATED GRAFTING OF POROUS POLYMER MONOLITHS AND THERMOPLASTIC POLYMERS FOR MICROFLUIDIC DEVICES

CROSS REFERENCE TO RELATED APPLICATIONS

This application claims priority to U.S. Provisional Patent Application No. 60/412,419, which was filed on Sep. 20, 2002, which is incorporated by reference in its entirety.

STATEMENT OF GOVERNMENT SUPPORT

This work was supported the U.S. Department of Energy under contract No. DE-AC03-76SF00098. The government has certain rights in this invention.

BACKGROUND OF THE INVENTION

1. Field of the Invention

This invention relates to microfluidic and fluid handling devices and the modification of pore surface chemistry of porous polymer monoliths and thermoplastic polymers by photoinitiated grafting, surface modification and functionalization.

2. Description of the Related Art

The current rapid development of microfabricated analytical devices is fueled by the need of significant improvements in speed, sample throughput, cost, and handling of analyses. A variety of applications involving, for example, sensors, chemical synthesis or biological analysis have already been demonstrated using the microfluidic chip format. More complex micro total analysis systems (μTAS) or 'Lab-on-a-Chip' are expected to be implemented by combining a variety of functional building blocks within the chip. Current approaches to μTAS largely rely on the use of inorganic substrates such as glass, silica, and quartz in which the desired network of channels and other features are prepared using etching processes. The popularity of these materials stems from the ease of design and fabrication of prototypes as well as small series of microfluidic chips using the standard methods of microelectronics such as patterning and etching.

However, the cost of the multistep wet fabrication of these microfluidic chips is high and the use of thermoplastic polymer materials instead of hard inorganics would enable the use of inexpensive 'dry' techniques such as injection molding or hot embossing. Consequently, there is growing interest in the development of polymeric substrates for the fabrication of microfluidic chips.

The chemistry of the surface of polymer-based devices is determined by the thermoplastic material used for their fabrication. For example, most of the commodity polymers available for this application are hydrophobic. These materials include for example polycarbonates (PC), poly(methyl methacrylate) (PMMA), polydimethylsiloxane (PDMS), poly(butylene terephthalate), and polyolefins such as polyethylene, polypropylene (PP), poly(2-norbornene-co-ethylene) ("cyclic olefin copolymer", COC), and hydrogenated polystyrene (PS-H). As a result of strong hydrophobic interactions, their surfaces can capture specific compounds from solution passing through the channels, changing their concentration in the solution, thus negating their precise quantitation. In addition, any molecules deposited on the wall of the channel also continuously change the character of the surface further affecting both adsorption of other molecules and the reliability of quantitative assays.

Despite the undeniable success of microfluidic chip technologies in a variety of applications, some problems persist. For example, almost all of today's reported microfluidic chips feature open channel architecture. Hence, the surface to volume ratio of these channels is rather small. This is a serious problem in applications such as chromatographic separations, heterogeneous catalysis, and solid phase extraction that rely on interactions with a solid surface. Since only the channel walls are used for the desired interaction, these microdevices can handle only minute amounts of compounds. Packing the channels with porous particles that significantly increase the available surface area and also enable the introduction of specific chemistries into the device can solve the issue of limited surface area in the macroscopic devices.

Previously, a novel format of porous materials—rigid macroporous monoliths polymerized in situ within the confines of a mold have been developed. See Svec, F.; Fréchet, J. M. J. *Anal. Chem.* 1992, 54, 820; Svec, F.; Fréchet, J. M. J. *Science* 1996, 273, 205 and U.S. Pat. Nos. 5,334,310; 5,453,185; 5,728,457; and 5,929,214, which are hereby incorporated by reference in their entirety, which describe the compositions of these monoliths in chromatographic columns and methods of making them. The porous structure of these monoliths is well controlled by varying the composition of the polymerization mixture and the polymerization temperature. The attachment of chains of functional polymers to the reactive sites at the surface of the pores affords multiple functionalities emanating from each individual surface site, thus dramatically increasing the density of surface groups. This has been demonstrated in U.S. Pat. Nos. 5,593,729 and 5,633,290, which are hereby incorporated by reference in their entirety, that the pores of monoliths can be selectively chemically modified.

Grafting is another way of tailoring surface chemistry. Several methods have been used to graft polymers onto thermoplastic polymer surfaces including such widely diverse methods as flame treatment, corona discharge treatment, plasma treatment, use of monomeric surfactants, acid treatment, free radical polymerization and high energy radiation. See, for example, Uyama, Y. et al., *Adv. Polym. Sci.* 1998, 137, 1.

Attachment of chains of polymer to the sites at the pore surface within a generic monolith provides multiple functionalities emanating from each individual surface site and dramatically increases the density of surface functionalities. Examples of grafting and functionalization of porous polymers and monoliths using free radical polymerization initiation can be found in the art. Viklund, C. et al. in *Macromolecules* 2000, 33, 2539, incorporate zwitterionic sulfobetaine groups into porous polymeric monoliths. Peters, et al. have previously shown in U.S. Pat. No. 5,929,214, that thermally responsive polymers may be grafted to the surface of pores within a polymer monolith by a two-step grafting procedure which entails (i) vinylization of the pores followed by (ii) in situ free radical polymerization of a selected vinyl monomer or mixture of selected monomers. The thermally responsive polymer changes flow properties through the pores in response to temperature differences.

Surface photografting with vinyl monomers has been used for functionalization of polymer fibers, films and sheets as for example described by Rånby B. et al., in *Nucl. Instrum. Methods Phys. Res. Sect. B,* 1991, 151, 301. However, although photografting has been used for modification of flat two dimensional surfaces, photografting of three dimensional highly crosslinked porous polymer monoliths functionalize or bind them to polymer surfaces has not been demonstrated since these materials were generally assumed to be opaque or diffractive.

SUMMARY OF THE INVENTION

The present invention is generally directed to a microfluidic device formed from a surface-modified rigid substrate such as a thermoplastic polymer, having a channel containing a porous polymer monolith. UV initiated photografting mediated by a hydrogen abstracting photoinitator is used to modify the channel surface, to create the porous monolith and to modify the monolith in selected regions.

Modification and surface functionalization of the preferred thermoplastic polymers is accomplished by photoinitated grafting only within a specified space (i.e. a microfluidic channel or a portion thereof), which also permits the layering and patterning of different functionalities on the surface of thermoplastic polymers. This will overcome the poor compatibility of most commercially available thermoplastics and porous monoliths. Poor bonding of the monoliths to surface, e.g. the walls of plastic channels, is prevented, and voids do not develop at the monolith-surface interface thereby preventing significant deterioration in the performance of the devices.

The present device is directed to a microfluidic device, comprising: (a) at least one channel for conducting a fluid, said channel having an internal channel surface formed in a substrate; (b) a first polymer attached to the channel surface through photoinitiated grafting of a first monomer to selected regions of the channel surface; and (c) a porous polymer monolith, comprised of a second monomer, in said channel, and attached to said first polymer in the selected regions, wherein the first and second monomers may be the same or different.

This device preferably is based on a substrate which is thermoplastic and transparent to light in the wavelength range of 200 to 350 nm. This allows light to pass through the substrate for photografting.

The substrate is preferably selected from the group consisting of poly(methyl methacrylate), poly(butyl methacrylate), poly(dimethylsiloxane), poly(ethylene terephthalate), poly(butylene terephthalate), hydrogenated polystyrene, and polyolefins such as cyclic olefin copolymer, polyethylene, polypropylene, and polyimide.

A preferred thermoplastic substrate is a polyolefin, and more preferably cyclic olefin copolymer. Exemplified substrates are PS-H, COC, and PP (as those terms are defined below).

The channels may be formed by known techniques and are preferably 10-200 μm deep, as described in more detail below.

The present invention comprises the feature of grafting the porous polymer monolith to the channel surface formed by the substrate. This grafting is accomplished by a first polymer attached to the channel surface, which may be comprised of one or more monomers selected from the group consisting of a polyvinyl monomer, a monovinyl monomer, and a mixture of a polyvinyl and monovinyl monomer.

The monovinyl monomer may be selected from the group consisting of acrylic acid, methacrylic acid, acrylamide, methacrylamide, alkyl derivatives of methacrylamide, alkyl derivatives of acrylamide, alkyl acrylates, alkyl methacrylates, perfluorinated alkyl acrylates, perfluorinated alkyl methacrylates, hydroxyalkyl acrylates, hydroxyalkyl methacrylates, wherein the alkyl group in each of the aforementioned alkyl monomers consists of 1-10 carbon atoms, vinylazlactone, oligoethyleneoxide acrylates, oligoethyleneoxide methacrylates, and acrylate and methacrylate derivatives including primary, secondary, tertiary, and quarternary amine and zwitterionic functionalities.

The polyvinyl monomer may be selected from one or more monomers selected from the group consisting of alkylene diacrylates, alkyl dimethacrylates, alkylene diacrylamides, alkylene dimethacrylamides, hydroxyalkylene diacrylates, hydroxyalkylene dimethacrylates, wherein the alkylene group in each of the aforementioned alkylene monomers consists of 1-6 carbon atoms, oligoethylene glycol diacrylates, oligoethylene glycol dimethacrylates, vinyl esters of polycarboxylic acids, divinyl ethers, pentaerythritol di-, tri-, or tetramethacrylates, pentaerythritol di-, tri-, or tetraacrylates, trimethylopropane trimethacrylates, trimethylopropane acrylates, alkylene bis acrylamides and alkylene methacrylamides.

Exemplified monomers for grafting are comprised of a monomer selected from the group consisting of AAm, BuA, AMPS, EDA, EDMA, MMA and MA (as those terms are defined below).

Components useful to form the porous polymer monolith have been described in connection with other microfluidic devices. Preferably, the porous polymer monolith is a copolymer comprised of polymerized polyvinyl monomers or a mixture of polyvinyl and monovinyl monomers. The polyvinyl monomers for the monolith may comprise one or more monomers selected from the group consisting of alkylene diacrylates, alkylene dimethacrylates, hydroxyalkylene diacrylates, hydroxyalkylene dimethacrylates, alkylene bisacrylamides, alkylene bismethacrylamides, wherein each of the aforementioned alkylene groups consists of 1-10 carbon atoms, oligoethylene glycol diacrylates, oligoethylene dimethacrylates, diallyl esters of polycarboxylic acids, divinyl ethers, pentaerythritol di-, tri-, or tetraacrylates, pentaerythritol di-, tri-, or tetra methacrylates, trimethylopropane triacrylates and trimethylopropane trimethacrylates.

Exemplified porous polymer monoliths are comprised of a mixture of monomers selected from the group consisting of HEMA, EDMA and BuMA (as those terms are defined below).

The photoinitiated grafting may be further applied to attach polymer chains having functional groups (e.g., hydrophilic, hydrophobic, ionizable or reactive groups) to the monolith. The device therefore may further comprise a polymer chain having a functional group attached to a portion of the porous polymer monolith by photoinitiated grafting of a third monomer, wherein the first and second monomers may be the same or different and the third monomer is different from the second monomer, and wherein the photoinitiator is an aromatic ketone.

The third monomer bearing the functional group may be selected from the group consisting of: acrylic acid, methacrylic acid, acrylamide, methacrylamide, alkyl acrylamide, alkyl methacrylamides, alkyl acrylates and methacrylates, perfluorinated alkyl acrylates and perfluorinated alkyl methacrylates, hydroxyalkyl acrylates, hydroxyalkyl methacrylates, wherein each of the aforementioned alkyl groups consist of 1-10 carbon atoms, vinylazlactone, oligoethyleneoxide acrylates, oligoethyleneoxide methacrylates, and acrylate and methacrylate derivatives wherein the derivatives comprise a primary secondary tertiary or quarternary amine or a zwitterion.

The third monomer bearing the functional group may also be selected from the group consisting of: methyl acrylate, methyl methacrylate, butyl acrylate, butyl methacrylate, tert-butyl acrylate, tert-butyl methacrylate, 2-hydroxyethyl acrylate, 2-hydroxyethyl methacrylate, acrylic acid, methacrylic acid, glycidyl acrylate, glycidyl methacrylate, 3-sulfopropyl acrylate, 3-sulfopropyl methacrylate, pentafluorophenyl acrylate, pentafluorophenyl methacrylate, 2,2,3,3,4,4,4-heptafluorobutyl acrylate, 2,2,3,3,4,4,4-heptafluorobutyl methacrylate, 1H,1H-perfluorooctyl acrylate, 1H,1H-perfluorooctyl methacrylate, acrylamide, methacrylamide, N-ethylacrylamide, N-isopropylacrylamide, N-[3-(dimethylamino)propyl]methacrylamide, 2-acrylamido-2-methyl-1-propanesulfonic acid, 2-acrylamidoglycolic acid, [2-(methacryloyloxy)ethyl]-trimethylammonium chloride, [2-(methacryloyloxy)ethyl]dimethyl(3-sulfopropyl)ammonium hydroxide, and 2-vinyl-4,4-dimethyl-azlactone.

Exemplified functional monomers are AMPS, BuA and VAL.

The present invention further comprises methods for making the present microfluidic devices. These methods include a method for preparing a microfluidic channel in a microfluidic device, comprising: (a) providing a substrate having at least one channel disposed thereupon; (b) filling the channel with a first monomer solution comprising a photoinitiator and a monomer; (c) exposing the solution to light for polymerizing said solution to a predetermined degree to form a polymer layer grafted to the wall of said channel; (d) removing ungrafted monomer from the channel; (e) filling the channel provided with the grafted polymer layer with a second monomer mixture including a photoinitiator for formation of a porous polymer monolith; and (f) exposing the second monomer mixture to light for polymerizing said second monomer mixture to form a porous polymer monolith attached to the wall of said channel through the grafted polymer layer.

As in the case of the device, a step for adding a functional group to the porous polymer monolith may also be included.

Particular features include the use of a photoinitiator for UV induced polymerization reactions; the use of various solvents and porogens; and the particular technique of adding the grafting layer to the channel surface so as to leave unreacted groups for coupling to the monolith disposed in the channel.

BRIEF DESCRIPTION OF THE DRAWINGS

FIG. 1 is a top view of a microfluidic device having orthogonally intersecting channels (FIG. 1A). FIG. 1B is an enlarged view of a portion of a single channel having a functionalized porous polymer monolith bound to the channel by the grafted polymer layer. FIG. 1C is an enlarged cross-sectional view taken along line C-C of FIG. 1B showing the functionalized porous polymer monolith bound to the channel by the grafted polymer layer and having a clear channel cover.

DETAILED DESCRIPTION OF THE PREFFERRED EMBODIMENT

Definitions

Figure 2:
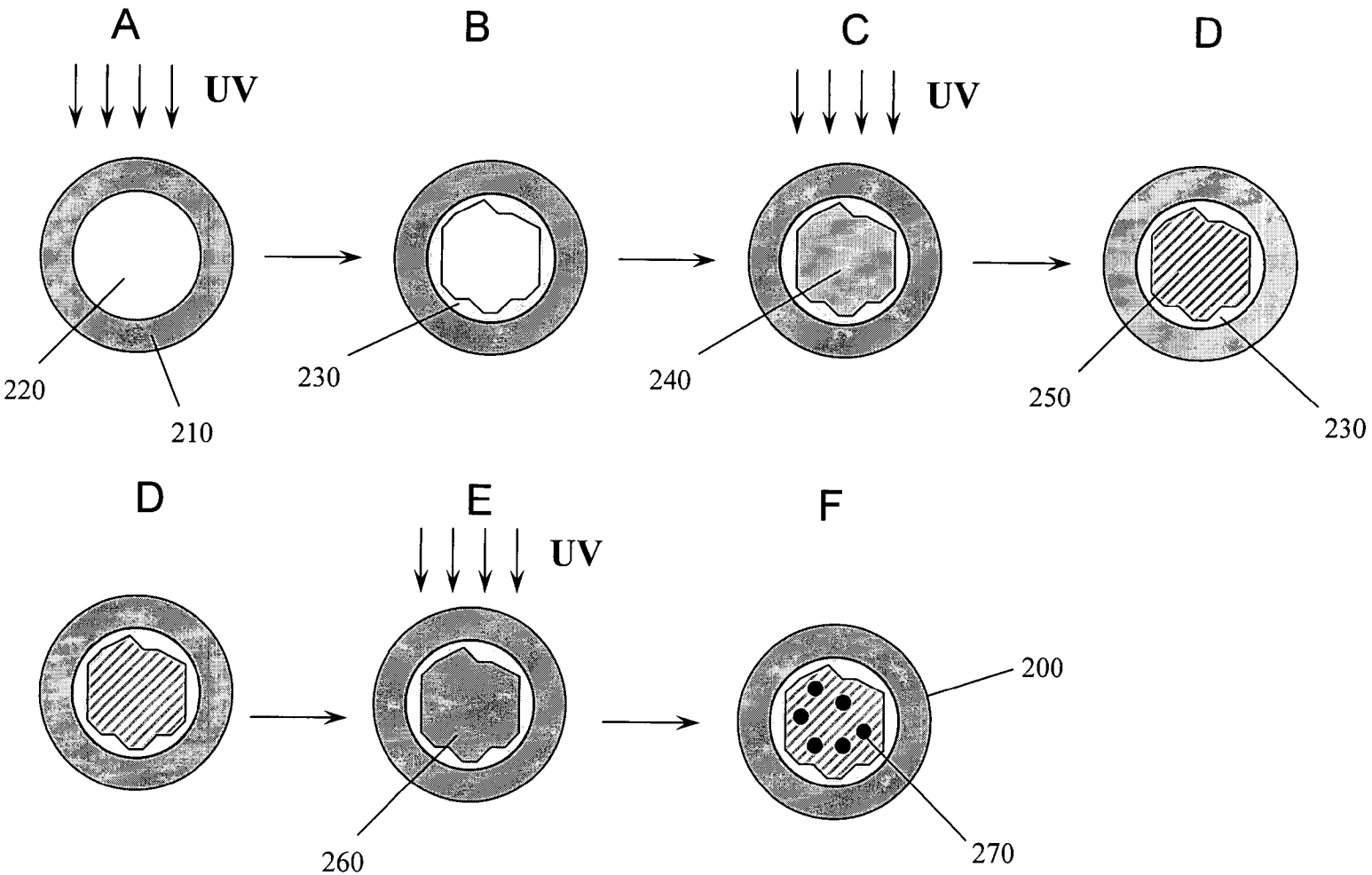
FIG. 2 is a cross-sectional view of a channel of the present microdevice showing surface modification with UV light (FIG. 2A); the resulting grafted channel (FIG. 2B); a second monomer for forming a monolith in the channel being crosslinked with UV light (FIG. 2C); a bonded monolith (FIG. 2D); a channel and monolith containing a third monomer solution and being irradiated (FIG. 2E); and a functionalized monolith covalently bound to the microchannel (FIG. 2F).

The term "thermoplastic polymer" is used herein to mean any polymer that softens at increased temperature.

The term "channel" is used herein to mean any capillary, channel, tube or groove that is disposed within or upon a substrate.

The terms "photografting" or "photoinitiated grafting" are used interchangeably herein to mean a process wherein ultraviolet light is used to initiate a polymerization reaction that originates from the surface of the substrate that is grafted upon.

The term, "a binary porogenic solvent" is used herein to mean a combination of two porogenic solvents.

The term, "wt %" or "weight percent" is the percent of composition by weight. Unless otherwise noted, all percentages herein listed are denoted to mean weight percent.

Grafting efficiency, "$N_{eff}$," is obtained from X-ray photoelectron spectroscopy (XPS) spectra by monitoring various atoms present on the grafted surface and comparing observed and theoretical values. If a substrate is a pure hydrocarbon, it only affords an XPS signal for carbon. Therefore, both the atomic (atom/C) ratio and consequently $N_{eff}$ equal 0. If the grafting of a monomer onto the substrate results in the incorporation of other atoms, the atom/C ratio increases, and so does $N_{eff}$. If the thickness of the grafted polymer layer exceeds the depth that can be examined by XPS (~10 nm), no further change in atomic ratios can be observed, and the efficiency reaches the maximum value of 1. It must be emphasized that the value of $N_{eff}$ is not the yield of the grafting reaction, but rather it is a measure of its success.

"$T_g$" is used herein to mean the glass transition temperature of the given polymer.

"o.d." is used herein to mean outer diameter.

"i.d." is used herein to mean inner diameter.

The following abbreviations are used herein to mean the compounds as indicated: methyl acrylate (MA), methyl methacrylate (MMA), 2-acrylamido-2-methyl-1-propanesulfonic acid (AMPS), butyl acrylate (BuA), butyl methacrylate (BuMA), tert-butyl acrylate (tBuA), tert-butyl methacrylate (tBuMA), 2-hydroxyethyl acrylate (HEA), 2-hydroxyethyl methacrylate (HEMA), acrylic acid (AAc), methacrylic acid (MAAc), glycidyl methacrylate (GMA), ethylene diacrylate (EDA), ethylene dimethacrylate (EDMA), acrylamide (AAm), N-isopropylacrylamide (NIPAAm), potassium salt of 3-sulfopropyl acrylate (SPA), (2-acrylamido-2-methyl-1-propanesulfonic acid (AMPS), 2-acrylamidoglycolic acid monohydrate (AGA), [2-(methacryloyloxy)ethyl]-trimethylammonium chloride (META), N-[3-(dimethylamino)propyl]methacrylamide (DPMA), benzophenone (BP), 2,2-dimethoxy-2-phenylacetophenone (DMAP), 1,1,1,3,3,3-hexafluoro-2-propanol (HFP) and 2,2-dimethoxy-2-phenylacetophenone (DAP). N-ethylacrylamide (NEAAm), pentafluorophenyl acrylate (PFPA), 2,2,3,3,4,4,4-heptafluorobutyl acrylate (HFBA) and 1H,1H-perfluorooctyl acrylate (PFOA), potassium salt of 3-sulfopropyl methacrylate (SPM), [2-(methacryloyloxy) ethyl]dimethyl(3-sulfopropyl)ammonium hydroxide (SPE), 4,4-dimethyl-2-vinylazlactone (VAL), poly(butyl methacrylate) (PBuMA), poly(methyl methacrylate) (PMMA), poly (dimethyl siloxane) (PDMS) polypropylene (PP), polycarbonate (PC), the copolymer of 2-norbornene and ethylene ("cyclic olefin copolymer", COC), and hydrogenated polystyrene (PS-H).

Introduction

Surface modified thermoplastic polymers and pore surface modified porous polymer monoliths are prepared using UV initiated photografting mediated by a photoinitator. In a preferred embodiment, the method is applied specifically for the surface modification and functionalization of thermoplastic polymers and porous polymer monoliths for use in microfluidic and similar devices.

The microfluidic device is preferably made of thermoplastic polymer that includes a channel or a multiplicity of channels whose surfaces are modified by photografting. The device further includes a porous polymer monolith prepared via UV initiated polymerization within the channel, and functionalization of pore surface of this monolith using photografting. Processes for making such surface modifications of thermoplastic polymers and porous polymer monoliths are also set forth.

Referring now to FIG. 1, a simplified embodiment of the present microfluidic device is shown. FIG. 1 shows a top view of a representative microfluidic device 100 having two orthogonally intersecting channels 110 (FIG. 1A) and fluid reservoirs 130 on each end of the channels. A functionalized porous polymer monolith 120 is disposed within a channel below the channel intersection, enabling the flow of samples for mixing, separation, concentration or other types of fluid handling. FIG. 1B is an enlarged top view of a portion of the channel in FIG. 1A, having a functionalized porous polymer monolith 120 bound to the channel by the grafted polymer layer 140. FIG. 1C is an enlarged cross-sectional view taken along line C-C of FIG. 1B showing the functionalized porous polymer monolith 120 bound to the channel 110 by the grafted polymer layer 140 and having a clear channel cover 150.

A user will place fluid samples in the reservoir 130 at the top of the channel above the channel intersection. The samples will flow down and be allowed to mix with fluid from reservoirs 132 and 132*a* at the intersection before flowing through the functionalized porous polymer monolith 120. Because the functionalized porous polymer monolith 120 is covalently bound to the channel 110, the fluids do not leak but are forced through the channel where the samples interact with the functional groups grafted to the porous polymer monolith. After passing through the functionalized porous polymer monolith 120, wherein the sample is mixed, separated, reacted, or otherwise acted on, the final product(s) can be obtained or recovered from the reservoir 134 below the functionalized porous polymer monolith 120.

The general photografting approach here described is amenable to any polymer substrate with sufficient UV transparency and enables the modification of selected parts of a surface. This concept is illustrated schematically in FIG. 2.

Referring now to FIG. 2, the surface of the substrate to be grafted upon (represented by a cross-sectional view of a microchannel 210 in FIG. 2A) is enclosed and filled with a first monomer, e.g., a monovinyl monomer, a polyvinyl monomer, or a mixture of monovinyl and polyvinyl monomers 220, and a photoinitiator, such as an aromatic ketone like benzophenone, and then irradiated with UV light (FIG. 2A). This grafting step is carried out under conditions that only proceed to a low conversion. After removal of the excess monomer, a grafted polymer layer 230 containing a number of unreacted double bonds remains chemically attached to the substrate surface (FIG. 2B). The coated surface is then filled with a second monomer contained in a polymerization mixture 240 suitable for the preparation of the desired porous polymer monolith. The mixture is irradiated with UV light to initiate polymerization (FIG. 2C). The residual double bonds in the grafted polymer layer 230 on the surface of the channel 210 are incorporated in the growing polymer chains, thus bonding the monolith 250 to the substrate surface (FIG. 2D) through the polymerized layer 230. Subsequently a third monomer 260 may be utilized to add functionalities to the monolith 250. The porous polymer monolith 250 is filled with the third monomer or its solution 260 and irradiated with UV light for a sufficient period of time (FIG. 2E) to graft the pore surface within the porous polymer monolith with this functional monomer to produce a channel having a porous polymer monolith containing functionalized groups 270 (FIG. 2F).

Figure 3:
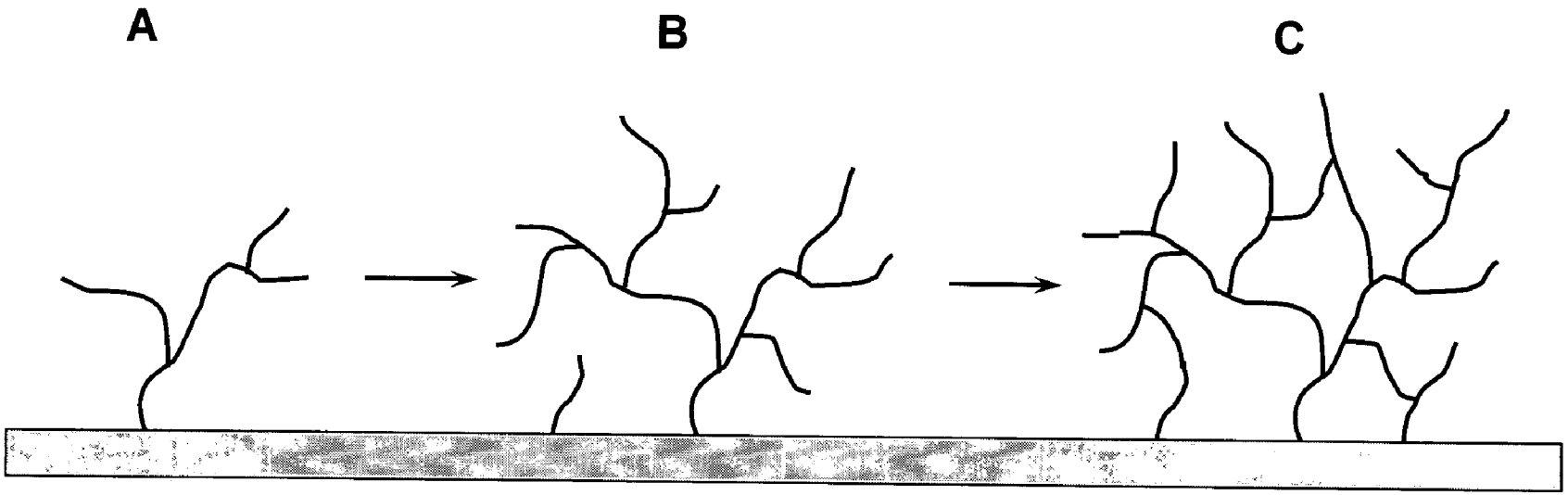
FIG. 3 is a schematic representation of the growing polymer chains during photografting of porous polymer monoliths with increasing irradiation time in each of FIG. 3A, FIG. 3B, and FIG. 3C.

FIG. 3 shows schematically the grafting process that occurs in FIG. 2A and FIG. 2E. At the beginning, only a limited number of polymer chains grow from the surface with relatively large distances between them (FIG. 3A). As the polymerization continues, the degree of branching increases since the grafting is also initiated by the abstraction of hydrogen from the already grafted chains (FIG. 3B). This brings the chains in closer proximity to each other, thereby enabling the onset of crosslinking. Finally, a dense crosslinked polymer network may be formed (FIG. 3C).

(1) Types of Thermoplastic Materials for Substrates

The present photografting method can be used for the surface modification of a wide range of thermoplastic polymers. The preferred substrates (i.e. for forming channel or tube surfaces) are selected from the group consisting of poly (methyl methacrylate), poly(butyl methacrylate), poly(dimethylsiloxane), poly(ethylene terephthalate), poly(butylene terephthalate), hydrogenated polystyrene, polyolefins such as, cyclic olefin copolymer, polyethylene, polypropylene, and polyimide. Polycarbonates and polystyrenes may not be transparent enough for efficient UV transmission and therefore may not be suitable for use as substrates.

Optical properties such as light transparency at the desired wavelength range and low background fluorescence are important characteristics of substrate materials that show potential for use in microfluidic and like devices of the invention. Since the photografting reactions must occur within the channels having on all sides, the light must first pass through a layer of this polymer. Therefore, the substrate materials should be transparent in a wavelength range of 200 to 350 nm, preferably between 230-330 nm.

In addition, the chemical properties and solubility of substrates can be taken into consideration. For instance, substrates that dissolve only in solvents, such as toluene and hexane, that are less likely to be used in standard microfluidic applications, make more desirable candidate substrate materials for photografting.

One important consideration in choosing substrate material for grafting is the grafting efficiency, expressed as $N_{eff}$, of the monomer to the substrate, which depends on properties such as the chemistry and transparency for light at the desired wavelength range. Grafting efficiency values of substrates correlate well with the irradiation power, the measured values of contact angles and the transparency of the substrate. An opaque substrate with a grafting efficiency value of 0 would be confirmed as one exhibiting similar results to PC in Table 4 of Example 4 wherein no transmitted light was detected using the material as a filter and no grafting is achieved even after 30 minutes of irradiation.

Thickness of only a few micrometers of a UV absorbing material or solution could decrease the intensity of the UV light and, consequently, the grafting efficiency. The depth of features in typical microfluidic devices may reach several tens of micrometers. Therefore, it is important to assess the effect of UV transparency of the grafting monomer mixtures during the grafting more exactly in order to determine the depth of the channel through which sufficient grafting can be safely achieved with the chosen monomer mixture. In general, the channel depth should be 10-500 μm, preferably 10-200 μm, most preferably 10-50 μm.

(2) Compositions of First Monomer and its Mixtures—Mixtures Used for Photografting to the Substrate to Form a Binding Surface Compositions of the grafting monomer mixtures useful for photografting are generally comprised of a bulk polyvinyl monomer, a bulk monovinyl monomer, or solutions of both a polyvinyl and monovinyl monomer, in a solvent and in the presence of 0.1 to 5% photoinitiator, preferably with 10 to 30% of monomer in the solution and 0.1 to 1% of photoinitiator, even more preferably about 10-20% monomer and 0.2-0.3% photoinitator. Mixtures shown in Table 1 represent preferred mixtures for use in this invention. For example, in a specific embodiment using acrylamide as the grafted monomer, Mixtures E and F containing about 15% bulk monomer and about 0.22% photoinitiator are preferably used.

Suitable polyvinyl monomers for the first monomer for photografting the substrate include alkylene diacrylates and dimethacrylates, alkylene diacrylamides and dimethacrylamides, hydroxyalkylene diacrylates and dimethacrylates, oligoethylene glycol dimethacrylates and diacrylates, alkylene vinyl esters of polycarboxylic acids, wherein each of the aforementioned alkylene groups consists of 1-6 carbon atoms, divinyl ethers, pentaerythritol di-, tri-, or tetramethacrylates or acrylates, trimethylopropane trimethacrylates or acrylates, alkylene bis acrylamides or methacrylamides, and mixtures thereof.

Monovinyl monomers suitable for grafting include but are not limited to acrylic and methacrylic acids, acrylamides, methacrylamides and their alkyl derivatives, alkyl acrylates and methacrylates, perfluorinated alkyl acrylates and methacrylates, hydroxyalkyl acrylates and methacrylates, wherein the alkyl group consists of 1-10 carbon atoms, oligoethyleneoxide acrylates and methacrylates, acrylate and methacrylate derivatives including primary, secondary, tertiary and quarternary amine and zwitterionic functionalities, and vinylazlactones, and mixtures thereof.

Specific preferred embodiments include monomers selected for photografting a thermoplastic substrate selected from the group consisting of methyl acrylate and methacrylate, butyl acrylate and methacrylate, tert-butyl acrylate and methacrylate, 2-hydroxyethyl acrylate and methacrylate, acrylic and methacrylic acid, glycidyl acrylate and methacrylate, 3-sulfopropyl acrylate and methacrylate, pentafluorophenyl acrylate and methacrylate, 2,2,3,3,4,4,4-heptafluorobutyl acrylate and methacrylate, 1H,1H-perfluorooctyl acrylate and methacrylate, acrylamide, methacrylamide, N-ethylacrylamide, N-isopropylacrylamide, N-[3-(dimethylamino)propyl]methacrylamide, 2-acrylamido-2-methyl-1-propanesulfonic acid, 2-acrylamidoglycolic acid, [2-(methacryloyloxy)ethyl]-trimethylammonium chloride, [2-(methacryloyloxy)ethyl]dimethyl(3-sulfopropyl)ammonium hydroxide, and 2-vinyl4,4-dimethyl-azlactone.

Since a variety of different chemistries might be required in microfluidic devices, the grafting conditions were optimized for a large number of monomers including perfluorinated, hydrophobic, hydrophilic, reactive, acidic, basic, and zwitterionic monomers, which cover a broad range of properties. Monomer groups in which the hydrogen abstraction readily occurs are preferred.

In some embodiments, it is preferred that the monomers for grafting exhibit a grafting efficiency of 1 or close to 1. However, since the goal is to photograft the surface with the desirable chemistry, it may be preferable to use monomers that are available despite their lower grafting efficiencies to produce the desired result.

A photomask can be attached prior to photoinitiation to permit grafting only in desired areas.

Solubility of some photoinitiators may be poor. Its higher concentration in solution can be achieved by adding a surfactant. However, while practice of the invention using such surfactants may be done, it is not highly recommended for use in grafting the first monomer to substrates. A drawback of the addition of surfactants is that mixtures may become turbid and affect grafting. Therefore, solutions containing the initiator and the surfactant should be closely monitored for clarity and transparency. Suitable surfactants include, but are not limited to, a block copolymer surfactant such as PLURONIC®, random copolymers of ethylene oxide and propylene oxide such as UCON™, and a polyoxyethylene sorbitan monooleate such as TWEEN®. All mixtures should be deoxygenated by purging prior to use in photografting.

Photoinitiator molecules for use in grafting monomers to thermoplastics are preferably aromatic ketones, including but not limited to, benzophenone, 2,2-dimethoxy-2-phenylacetophenone, dimethoxyacetophenone, xanthone, thioxanthone, their derivatives, and mixtures thereof.

In general, the extent of grafting can be controlled by irradiation time. Photoinitiated grafting should occur for all substrates to a low conversion. The irradiation time may vary but in general it is from 0.5 to 10 minutes, preferably about 2 to 5 minutes.

During photoinitated grafting, an increase in viscosity of the monomer or its solution is observed which indicates the concomitant formation of a considerable amount of polymer in the solution. The extent of this polymerization can be reduced by diluting the monomer with a suitable solvent. Suitable solvents should be capable of solubilizing the grafted monomer. Dilution with a solvent that has lower absorbancy in the UV range than the monomer itself also helps to reduce the negative self-screening effect of the monomer. Examples of suitable solvents include water, alcohols, such as tert-butyl alcohol (tBuOH), and their mixtures.

A very short irradiation and reaction time is preferred to avoid the rapid crosslinking if a pure divinyl monomer is used for photografting. In some experiments, 3 minutes of irradiation was sufficient to achieve the desire extent of photografting. However, if the reaction time is not sufficient to achieve the desired extent of surface modification, the grafting time can be extended or the monomer mixture can be changed, for example, by using a 1:1 mixture of divinyl and monovinyl monomer. A monovinyl monomer used in the grafting monomer solution decreases the crosslinking density of the grafted surface layer enabling it to swell in the polymerization mixture used later for the preparation of the monolith.

(3) Preparation of Porous Polymer Monoliths Through Photopolymerization of Second Monomer Mixture A porous polymer monolith useful for the preferred embodiment is a solid polymer body containing a sufficient amount of pores of sufficient size that enable convective flow. Preferred monoliths are those as disclosed in U.S. Pat. Nos. 5,334,310; 5,453,185; and 5,929,214, the subject matters of which are hereby incorporated by reference for purposes of describing monoliths. The preferred polymer monolith is prepared by polymerizing a polyvinyl monomer or, more preferably, a mixture of a polyvinyl and monovinyl monomer, in the presence of an initiator, and a porogen. The polymerization mixture is added to the channel and polymerization is initiated by UV irradiation therein so as to form the polymer monolith. The polymer monolith is then washed with a suitable liquid to remove the porogen.

In a preferred embodiment, the polymerization mixture is comprised of about 24 wt % monovinyl monomer, about 16 wt % polyvinyl monomer, and about 60 wt % porogens, whereby the photopolymerizations are carried out at room temperature. The ranges of each of the monomer, crosslinker and porogens can be varied according to the methods described in U.S. Pat. Nos. 5,334,310; 5,453,185; and 5,929,214. Table 6 in Example 10 demonstrates two examples, and shows the percentages of monomers and porogens in a polymerization mixture in a preferred embodiment.

The polyvinyl monomer is generally present in the polymerization mixture in an amount of from about 10 to 60 wt %, and more preferably in an amount of from about 20 to 40 wt %. Suitable polyvinyl monomers include alkylene diacrylates and dimethacrylates, hydroxyalkylene diacrylates and dimethacrylates, alkylene bisacrylamides and bismethacrylamides, wherein the alkylene group consists of 1-6 carbon atoms, oligoethylene glycol diacrylates and dimethacrylates, diallyl esters of polycarboxylic acids, divinyl ethers, pentaerythritol di-, tri-, or tetraacrylates and methacrylates, trimethylopropane triacrylates and trimethacrylates, and mixtures thereof.

Preferred monovinyl monomers include but are not limited to, acrylic and methacrylic acids, acrylamides, methacrylamides and their alkyl derivatives, alkyl acrylates and methacrylates, perfluorinated alkyl acrylates and methacrylates, hydroxyalkyl acrylates and methacrylates, wherein the alkyl group consists of 1-10 carbon atoms, oligoethyleneoxide acrylates and methacrylates, vinylazlactones, acrylate and methacrylate derivatives including primary, secondary, tertiary, and quarternary amine functionalities and zwitterionic functionalities, and mixtures thereof.

The porogen used to prepare the monolith may be selected from a variety of different types of materials. For example, suitable liquid porogens include aliphatic hydrocarbons, esters, alcohols, ketones, ethers, solutions of soluble polymers, and mixtures thereof. The porogen is generally present in the polymerization mixture in an amount of from about 40 to 90 wt %, more preferably from about 60 to 80 wt %.

In a preferred embodiment, the composition of porogenic solvent is used to control porous properties. The percentage of decanol in the porogenic solvent mixture with a co-porogen, such as cyclohexanol or butanediol, affects both pore size and pore volume of the resulting monoliths. A broad range of pore sizes can easily be achieved by simple adjustments in the composition of porogenic solvent.

In contrast to the pore size, the type of porogen has only a little effect on the pore volume since, at the end of the polymerization, the fraction of pores within the final porous polymer is close to the volume fraction of the porogenic solvent in the initial polymerization mixture because the porogen remains trapped in the voids of the monolith.

In the preferred embodiment, the pore size would depend on the ultimate use of the porous polymer monolith. A preferred pore size in a preferred embodiment is greater than about 600 nm because this size enables flow through at a useful velocity and reasonable back pressure. However, smaller pores also may be useful and suitable.

Efficient polymerization of the porous polymer monolith is achieved by using free radical photoinitiators. In the preferred embodiment, about 0.1 to 5 wt % with respect to the monomers of hydrogen abstracting photoinitiator can be used to create the porous polymer monolith. Typically, 1 wt % with respect to monomers of a hydrogen abstracting photoinitiator including, but not limited to, benzophenone, 2,2-dimethoxy-2-phenylacetophenone, dimethoxyacetophenone, xanthone, thioxanthone, their derivatives and mixtures thereof is used.

Surfactants, such as PLURONIC F-68, can be added to improve the solubility of photoinitiators. Suitable surfactants include, but are not limited to, a block copolymer surfactant such as PLURONIC®, random copolymers of ethylene oxide and propylene oxide such as UCON™, and a polyoxyethylene sorbitan monooleate such as TWEEN®. All mixtures should be deoxygenated by purging prior to use in photografting.

(4). Conditions and Optimization of Process for Grafting Porous Polymer Monoliths with Third Monomer Mixture to Form Functionalized Monoliths After the porous polymer monolith has been polymerized and prepared in the channel or capillary, it is filled with the third functional monomer, or mixture of more than one monomer, or their solution and then irradiated. Alternatively, the third monomer mixture may further comprise a solvent. The third monomer mixture is deaerated and then pumped to fill the pores of the monolith. The mixture is generally comprised of a bulk monomer or its 10 to 50% solution in a solvent and 0.1 to 5% photoinitiator, preferably 10 to 30% of monomer in the solution and 0.1 to 1% of photoinitiator.

The general embodiment also contemplates the addition of a small percentage of a polyvinyl monomer to the third monomer or its solution to create a gel-like structure at the pore surface, thereby avoiding the loss of a functional monomer by formation of ungrafted soluble chains. The amount of the crosslinker also controls the swelling of the gel and thus the final pore size in the solvated state.

Grafting is preferably achieved by irradiation of a stationary porous monolith filled with the third monomer solution through a mask from a sufficient distance for a sufficient period of time to graft polymer chains having functional groups to the monolith. When the irradiation step is complete, the capillary is then washed to remove residual monomer solution. Any solvent that dissolves the residual polymer can be used to wash the capillary. Furthermore, solvents that will be used in the next application of the grafted polymer monolith, such as the mobile phase to separate peptides, can be used as the solvent to wash the capillary.

Suitable monomers for photografting porous polymer monoliths possess a variety of functionalities, but are in no way limited to, hydrophilic, hydrophobic, ionizable, and reactive functionalities.

Examples of suitable monomers for photografting porous polymer monoliths include, but are not limited to, methyl acrylate and methacrylate, butyl acrylate and methacrylate, tert-butyl acrylate and methacrylate, 2-hydroxyethyl acrylate and methacrylate, acrylic and methacrylic acid, glycidyl acrylate and methacrylate, 3-sulfopropyl acrylate and methacrylate, pentafluorophenyl acrylate and methacrylate, 2,2,3,3,4,4,4-heptafluorobutyl acrylate and methacrylate, 1H,1H-perfluorooctyl acrylate and methacrylate, acrylamide, methacrylamide, N-ethylacrylamide, N-isopropylacrylamide, N-[3-(dimethylamino)propyl]methacrylamide, 2-acrylamido-2-methyl-1-propanesulfonic acid, 2-acrylamidoglycolic acid, [2-(methacryloyloxy)ethyl]-trimethylammonium chloride, [2-(methacryloyloxy)ethyl]dimethyl(3-sulfopropyl)ammonium hydroxide, and 2-vinyl-4,4-dimethyl-azlactone.

In the preferred embodiment, about 0.22% (wt % with respect to solution) hydrogen abstracting photoinitiator can be used for grafting porous polymer monoliths. Typically, 1 wt % with respect to monomers of a hydrogen abstracting photoinitiator including, but not limited to, benzophenone, 2,2-dimethoxy-2-phenylacetophenone, dimethoxyacetophenone, xanthone, thioxanthone, their derivatives and mixtures thereof is used.

Solubility of some photoinitiators may be poor. Its higher concentration in solution can be achieved by adding a surfactant. However, while practice of the invention using such surfactants may be done, it is not highly recommended. A drawback of the addition of surfactants is that mixtures may become turbid and affect grafting. Therefore, solutions containing the initiator and the surfactant should be closely monitored for clarity and transparency.

In a preferred embodiment, the desirable solvent for use in photografting polymer monoliths (i) should not absorb excessively in the UV range to exert minimum self-screening effect, (ii) should not allow hydrogen abstraction, thereby being incorporated into the polymer layer by termination reactions and/or initiate undesired homopolymerization, and (iii) must dissolve all components of the third monomer mixture (monomer and initiator). A preferred solvent is water, t-butanol (tBuOH) and its mixtures with water, that all meet these criteria.

A consideration in determining the appropriate grafting time is the thickness of the grafted polymer layer and extent of surface modification of the porous polymer monolith. Extended grafting time leads to clogging the pores of the porous polymer monolith, thus increasing the back pressure needed to pump any fluids through the grafted porous polymer monolith. Continuous increase in the flow resistance measured as the back pressure of water pumped through the monolith with the grafting time is also a good indication of the increase in thickness of the grafted polymer layer.

The preferred embodiment enables the functionalization by photoinitiated grafting of porous materials located within capillaries, microfluidic channels, and other suitable devices. Functionalization permits porous polymer monoliths within the capillaries and channels of microfluidic and other devices to be used for various procedures such as mixing, concentrating, and separation reactions. Thus, the preferred embodiment facilitates the design and preparation of numerous functional elements that are instrumental to the development of complex microanalytical elements and systems.

Furthermore, a major advantage of the method described by the preferred embodiment is the ability to pattern grafted areas thus facilitating preparation of materials with different spatially segregated chemistries within a single porous polymer monolith. Functionalization of several areas can be controlled in terms of placement and extent as simultaneous or sequential functionalizations are possible.

For example in one embodiment, one would choose to use a polar molecule (e.g. AMPS) as the grafting monomer to increase the number of available ionizable functionalities in the channel and thereby increase electroosmotic flow and separation. In another embodiment, a zwitterionic monomer can used grafted to the monolith, whereby the monolith can then be used for capillary electrochromatography (CEC).

The additional benefit of photoinitated grafting is the ability to create patterns differing in properties such as surface coverage or type of the grafted chemistry. By placing masks over certain areas of the porous polymer monolith, patterns of different functionalities can be created. The sharp edges of the patterned features enable placing different functionalities within a porous polymer monolith next to each other with no dead volume between the functionalities, thereby allowing different elements to be placed directly adjacent to each other. In contrast to the typical "homogenous" grafting, the preparation of monoliths with longitudinal gradients of surface coverage or combining different chemistries using masks with a gradient of transparency for UV light is also contemplated by the invention.

Photografting also facilitates the preparation of layers of functionalities in a porous polymer monolith in both axial and radial direction with respect to the direction of flow.

The qualitative effect of the intensity of the UV light on the grafting efficiency is different polymers can be used as filters to modulate intensity. The use of a photomask, such as a multi density resolution mask (Series I, Ditric Optics, Hudson, Mass.), that includes several fields differing in UV light transmittance enables creation of creation of gradients. Grafting through masks with a gradient of absorbancy enables the fabrication of layers with both stepwise and continuous gradients of hydrophilicity, polarity, acidity, or combinations thereof, along the channel by simply using multidensity, continuous gray-scale photomasks, a moving shutter or the like.

(5) Alternative Applications for Photografting

The process of the present invention is also suitable for the photografting of layers of polymers. Using a sequence of photografting reactions, several layers can be polymerized on top of each other. This storied approach enables the generation of polymer shells and shielding of functionalities "hidden" in the lower layer preventing their interactions with specific compounds in an analyte solution. For example, the sulfonic acid groups of AMPS are required to generate electroosmotic flow, however, they can also absorb peptides and proteins via Coulombic interactions. Steric shielding can be achieved by covering the grafted AMPS layer on the thermoplastic substrate with another layer of polymer with desired properties. Steric shielding allows the AMPS layer to aid electrosmotic flow yet not interfere or interact with proteins and peptides. Thus, grafting in layers may be particularly useful for the preparation of microfluidic electrochromatographic devices.

Photografting triggered by UV light through a mask enables patterning, which is a major advantage of this method compared to both thermally and redox initiated grafting techniques. Copolymerization of two or more monomers can be used to fine-tune the surface properties. The percentage of each monomer incorporated in the polymer chains depends on their reactivity ratios and the composition of the polymerization mixture. Since the overall amount of grafted copolymer is small, both the composition of the monomer mixture and the composition of the formed polymer chains do not change significantly during the grafting process. Incorporation of some copolymers can be readily estimated from XPS spectra using atomic ratios.

Copolymerization also permits the incorporation of monomers into the grafted polymer layer at different rates based on the different reactivity ratios of the different monomers. This also permits creation of unique grafted layers which can be comprised of different monomers. For example, the grafted polymer layer can be composed of both hydrophobic and hydrophilic monomers to provide a unique functionality to the thermoplastic polymer surface.

One of the ultimate reasons for the photografting surfaces of thermoplastic substrates is to modify the walls of channels in microfluidic devices to hold porous polymer monoliths. Experiments were performed with thermoplastic polymer tubes demonstrate the absence of bonding of a polymer monolith to the surface of thermoplastic tubes that were not photografted. Large voids wee seen between the polymer matrix and the unmodified thermoplastic polymer tube resulting both from shrinkage during polymerization and the subsequent drying. The monolith was able to slip out of the tube without applying any force, leaving behind no visible traces at the surface.

In a preferred embodiment, the channel walls in a microfluidic device are photografted as described herein to achieve a firm covalent bond between the channel wall and porous polymer monoliths. This method described herein prevents the formation of voids at the monolith-wall interface.

EXAMPLE1

Screening and Photografting Suitable Thermoplastic Polymer Substrates

Figure 4:
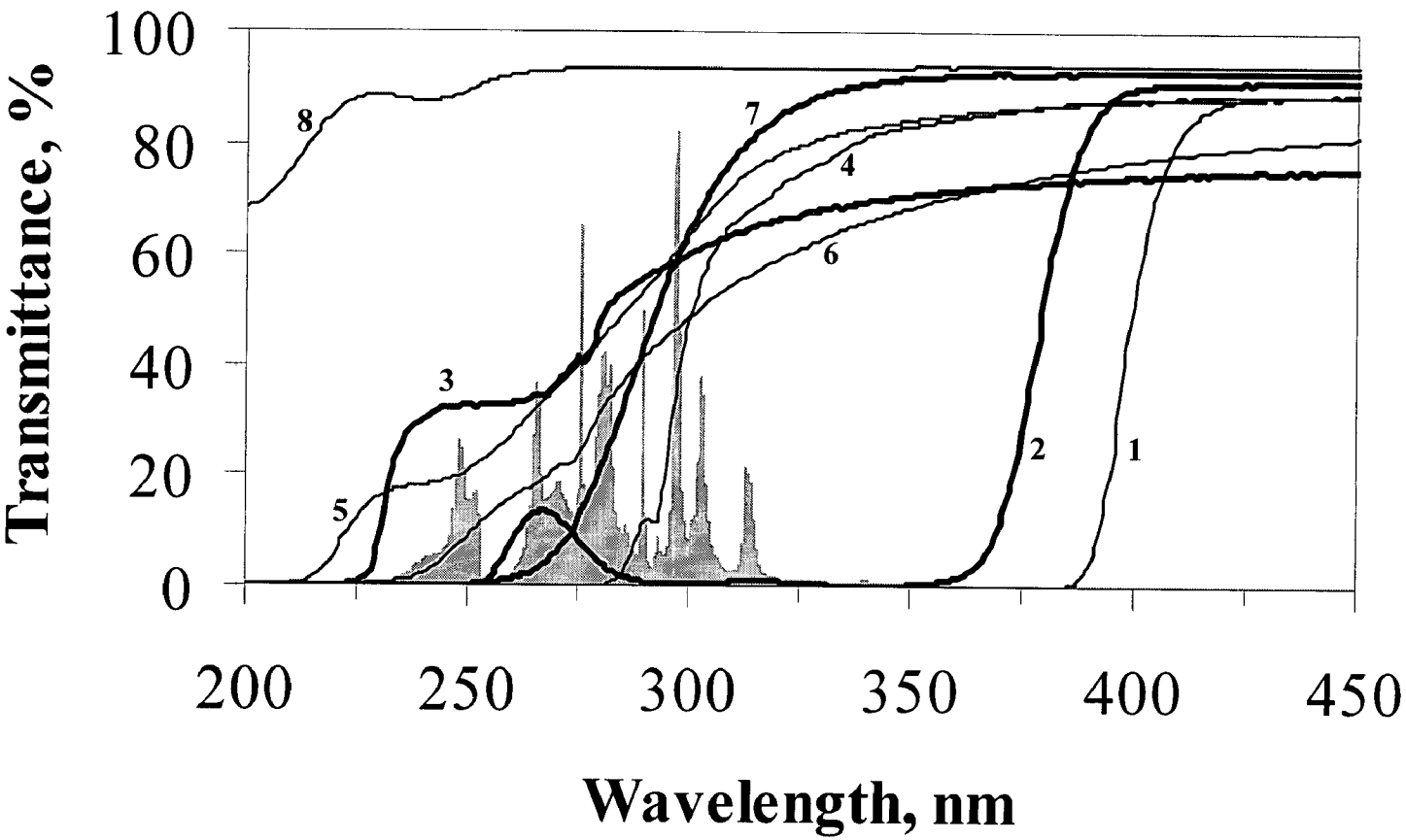
FIG. 4 is a graph showing the emission spectrum of the light source (gray) and UV spectra of polycarbonate (1), poly(methyl methacrylate) (2), polydimethylsiloxane (3), polystyrene (4), cyclic olefin copolymer (5), hydrogenated polystyrene (6), borofloat glass (7) and quartz (8).

The gray shaded area in FIG. 4 represents the emission spectrum of the UV lamp used and the UV-spectra of polycarbonate (1), poly(methyl methacrylate) (2), polydimethylsiloxane (3), polystyrene (4), cyclic olefin copolymer (5), hydrogenated polystyrene (6), borofloat glass (7) and quartz (8). FIG. 4 shows that quartz (8) is transparent in the entire range, while polycarbonate (1) is completely opaque and therefore not suitable for photografting. The other polymer materials tested all exhibit some transparency within this acceptable range of wavelength between 230-330 nm.

Among the synthetic polymers, PDMS exhibits the best transparency in the deep UV range. However, its very low $T_g$ makes this material suitable only for limited range of applications such as rapid prototyping. PS-H is also sufficiently transparent and enables acceptable grafting. The UV transparency of COC, a commercially available engineering thermoplastic, is close to that of PDMS and exceeds that of the glass. The same properties that make COC suitable for the manufacture of compact disks should make it useful for the reproduction of the fine relief features used in microfluidic devices. In addition, the chemical properties and solubility of COC are close to those of other members of the polyolefin family, including PE or PP. Furthermore, COC dissolves only in solvents such as toluene and hexane that are less likely to be used in standard microfluidic applications. The desirable combination of mechanical, optical, and chemical properties makes COC currently one the best commercial candidate materials for the mass production of microfluidic chips and therefore its use is broadly explored throughout the following Examples.

The extent of optical transparency suggested by UV spectra shown in FIG. 4 was confirmed by actual grafting experiments using a specifically designed chamber described herein that simulates the microchip. A well-defined COC surface was obtained by spin coating its solution onto the surface of a silicon wafer. This coated wafer placed in the test chamber was covered with a first monomer solution, and irradiated. In order to closely mimic the grafting conditions found within the actual microchip where the irradiation of the internal channel always occurs through the bonded top cover, a sheet of a polymer was placed on top of the assembled mold.

Spin Coating Substrates. A filtered 10 wt % solution of polymers in toluene (COC and PS) or acetone (PBuMA) was applied onto silicon wafers (50 mm×0.3 mm, Pure Sil, Bradford, Pa.), spin coated at 3,000 rpm for 40 s, and dried overnight at room temperature. The wafers were cut to four equal wedges prior to their grafting.

Photografting of flat materials. Spin coated silicon wafers or sheets of polymers were placed on the top of an aluminum base. A PE gasket (50 μm thick, unless otherwise stated) was applied to frame the flat sample, and a small channel was cut into the gasket at one corner. A 1.6 mm thick and 100 mm diameter quartz wafer containing a 1 mm hole was placed on the top of the gasket with the hole located at the side opposite to the channel in the gasket. This assembly was sandwiched between an aluminum ring and the base and fixed with 8 screws. The purged monomer solution was injected through the hole in the quartz wafer, and the void between the polymer surface and the quartz wafer defined by the gasket was filled with monomer solution via capillary action. A black tape mask was attached to the top of the quartz window exactly over the PE gasket to avoid photolamination between the base polymer and the gasket. The tape also covered the hole used for filling. Additional filters or photomasks were then placed on the top of this assembly. Illumination with UV light was carried out from a distance of 30 cm for sufficient period of time for each substrate. The grafted samples were carefully removed, washed first with a suitable solvent followed by extraction in this solvent for another 12 hours to remove soluble polymer, and dried in a vacuum oven at room temperature for 24 hours.

Photografting in PP tubes. Polypropylene micropipette tips were used as a model for the microchannels since their shape considerably facilitates the handling. The tube with an inner diameter of 800 μm was filled to a height of about 5 mm with the polymerization mixture A (Table 1) using capillary action, and irradiated from a distance of 25 cm for a specific period of time. Once the reaction was complete, the tubes were washed with acetone, extracted in the same solvent for 12 h, and dried in a vacuum oven at room temperature for 24 h.

EXAMPLE 2

Monomer Mixtures for Photografting

The compositions of the acrylamide reaction mixtures used for grafting according to Example 1 are summarized in Table 1. The surfactant PLURONIC F-68 was added to aqueous systems to improve the solubility of benzophenone. All mixtures were deoxygenated by purging with nitrogen for 10 min prior to photografting. Mixtures A, B, C, D, E and F represent different compositions. Mixtures E and F represent the preferred composition of reaction mixture for photografting in the following examples. "BP wt %" indicates the amount of benzophenone used to initiate polymerization.

TABLE 1

Reaction mixtures used for photografting

| Reaction mixture | Acrylamide wt % | BP wt % | Pluronic F-68 wt % | Solvent |
|---|---|---|---|---|
| A | bulk | 3.0 | 0 | None |
| B | 30 | 0.67 | 0.67 | $H_2O$ |
| C | 30 | 0.33 | 0.33 | $H_2O$ |
| D | 15 | 0.33 | 0.33 | $H_2O$ |
| E | 15 | 0.22 | 0 | tBuOH—$H_2O$ 3:1 |
| F | 15 | 0.22 | 0 | tBuOH |

EXAMPLE 3

Photografting Efficiencies and Contact Angles of Acrylamide on Various Substrate Photografting of acrylamide on COC using various polymers as filters was performed according to Example 1. Table 2 summarizes the results obtained after 2 min of grafting. Acrylamide was chosen since it contains nitrogen atoms, not present in COC and therefore useful in characterization. In addition, its grafting also changes the polarity of the original hydrophobic surface enabling further measurements for the purpose of characterization.

TABLE 2

Photografting of acrylamide on COC using various polymers as a filter

| | Irradiation power, mW/cm$^2$[a] | | 2 min irradiation | |
|---|---|---|---|---|
| Filter | 260 nm | 310 nm | $N_{eff}$[b] | Contact angle |
| Quartz | 12.5 | 12.1 | 0.79 | 45 |
| Borofloat glass | 5.8 | 9.5 | 0.73 | 60 |
| PS | 2.1 | 5.6 | 0.62 | 61 |
| PS-H | 4.7 | 6.8 | 0.67 | 55 |
| COC | 7.9 | 9.6 | 0.79 | 48 |
| PDMS | 6.1 | 8.7 | 0.71 | 54 |
| PMMA | 0.4 | 0.1 | 0.39 | 60 |
| PC | 0 | 0 | 0[c] | 85[c] |

[a]Two probe heads (260 and 310 nm) cover the range between 220 nm and 340 nm shown in FIG. 4.
[b]Grafting efficiency calculated from atomic ratios determined by XPS (N/C found)/(N/C theoretical).
[c]Irradiation time 30 min.

The results of Table 2 clearly confirm the opacity of PC since no transmitted light was detected using this material as a filter and no grafting was achieved even after 30 min of irradiation. However, transmittance of UV light and photografting were observed for all other materials. The grafting efficiency values correlate well with the irradiation power for both probe heads and with the measured values of contact angles. The similarity of grafting obtained by irradiation through Borofloat glass, PS, and PDMS—all materials with very different optical properties—indicates that efficient photografting takes place within a broad range of wavelengths from 200 to 350 nm.

The lowest grafting efficiency was observed for PMMA, which has only a small transmission window at 260 nm. For further tests, COC, PS, as well as PBuMA were spin coated, while Parylene C was vapor deposited on silicon wafers. Flat sheets of PMMA, PS-H, and PDMS were used directly and PP films were prepared by melting small pieces of this polymer between two glass slides. These samples were placed in the polymerization chamber, and the top quartz window was not covered with any polymer for these experiments. All the grafting experiments were carried out using acrylamide to enable monitoring of nitrogen atoms by XPS.

Table 3 shows the contact angles prior to and after grafting, as well as the grafting efficiencies. With an irradiation time of 5 min, grafting occurred for all substrates containing easily abstractable methylene or methine hydrogen atoms. Best results were observed with COC, while PDMS having only methyl groups reacted slowly with 30 min of irradiation needed to achieve the desired grafting efficiency. Good results were also obtained for grafting onto PBuMA (data not shown).

TABLE 3

Photografting of various thermoplastic channel polymers with acrylamide.[a]

| | | Contact angle | | |
|---|---|---|---|---|
| Polymer | Structure | original | grafted | $N_{eff}$[b] |
| COC | 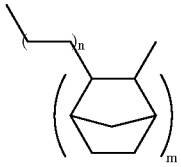 | 89 | 46 | 0.89 |
| PS | 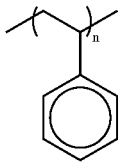 | 90 | 52 | 0.71 |
| PS-H | 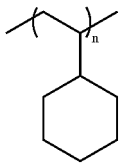 | 89 | 47 | 0.82 |
| PP | 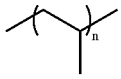 | 91 | 46 | 0.85 |
| Parylene C | 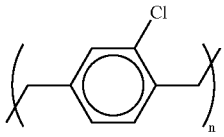 | 86 | 47 | 0.68 |
| PBuMA | 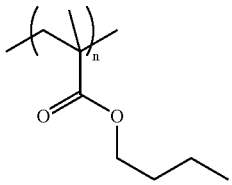 | 78 | 50 | 0.63 |

TABLE 3-continued

Photografting of various thermoplastic channel polymers with acrylamide.[a]

| Polymer | Structure | Contact angle original | Contact angle grafted | $N_{eff}$[b] |
|---|---|---|---|---|
| PMMA | 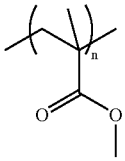 | 66 | 53 | 0.62 |
| PDMS[c] | 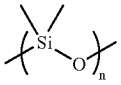 | 98 | 68 | 0.49 |

[a]Monomer mixture C, irradiation time 5 min. For other conditions see Example 11.
[b]Grafting efficiency as the ratio (N/C found)/(N/C theoretical).
[c]Irradiation time 30 min.

EXAMPLE 4

Photografting Efficiencies and Contact Angles of Various Grafting Monomers on COC Table 4 shows the grafting efficiencies calculated from XPS data. Most of the monomers graft well onto COC substrate; generally, acrylates are superior to methacrylates, for which the hydrogen abstraction occurs also from the methyl group of the methacryloyl moiety producing a less reactive allylic radical. In addition, the polymethacrylate backbone only contains quaternary carbons and methylene groups from which the hydrogen atoms can only be abstracted, whereas polyacrylate chains contain both methylene and more reactive methine hydrogens that both facilitate grafting and the formation of highly branched structures.

Some of the grafting efficiencies shown in Table 4 exceed the highest theoretical value of 1. This can be assigned to the overall calibration error inherent to XPS.

TABLE 4

Photografting of COC with various monomers

| Monomer | Conditions/ Extraction | Irrad[a] | Structure | R | Grafting efficiency[b] O | N | S | F |
|---|---|---|---|---|---|---|---|---|
| MA | A/acetone | 5 | 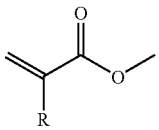 | H | 0.86 | — | — | — |
| MMA | A/acetone | 5 | | $CH_3$ | 0.55 | — | — | — |
| BuA | A/acetone | 5 | 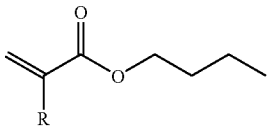 | H | 1.05 | — | — | — |
| BuMA | A/acetone | 5 | | $CH_3$ | 0.61 | — | — | — |
| tBuA | A/acetone | 5 | 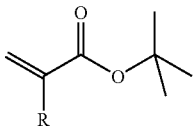 | H | 1.23 | — | — | — |
| tBuMA | A/acetone | 5 | | $CH_3$ | 0.86 | — | — | — |
| HEA | B/$H_2O$ | 0.5 | 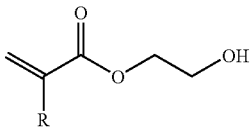 | H | 0.47 | — | — | — |
| HEMA | B/$H_2O$ | 5 | | $CH_3$ | 0.93 | — | — | — |
| AAc | B/$H_2O$ | 5 | 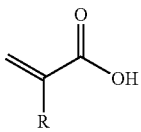 | H | 0.86 | — | — | — |
| MAAc | B[c]/$H_2O$ | 5 | | $CH_3$ | 0.86 | — | — | — |
| GMA | A/acetone | 5 | 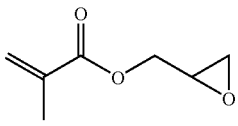 | — | 0.26 | — | — | — |

TABLE 4-continued

Photografting of COC with various monomers

| Monomer | Conditions/ Extraction | Irrad[a] | Structure | R | Grafting efficiency[b] O | N | S | F |
|---|---|---|---|---|---|---|---|---|
| EDA | A/acetone | 0.5 | 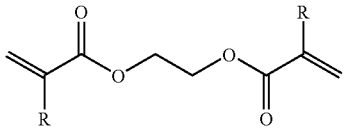 | H | 0.92 | | | |
| EDMA | A/acetone | 0.5 | | $CH_3$ | 0.16 | | | |
| | | 2 | | $CH_3$ | 0.68 | | | |
| AAm | $C/H_2O$ | 5 | 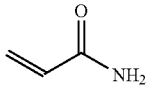 | — | 0.72 | 0.90 | — | — |
| NIPAAm | $D^c/H_2O$ | 5 | 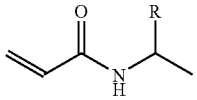 | $CH_3$ | 0.99 | 0.87 | — | — |
| | $E/H_2O$ | | | $CH_3$ | 0.97 | 0.91 | — | — |
| NEAAm | $E/H_2O$ | 5 | | H | 0.62 | 0.52 | — | — |
| SPA | $D^c/H_2O$ | 5 | 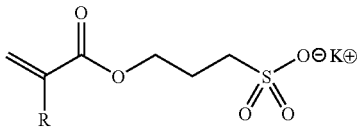 | H | 0.83 | — | 0.56 | — |
| SPM | $D^c/H_2O$ | 5 | | $CH_3$ | 0.77 | — | 0.45 | — |
| AMPS | $B^c/H_2O$ | 5 | 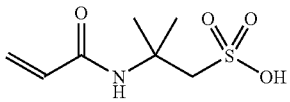 | — | 0.63 | 0.62 | 0.39 | — |
| | $E/H_2O$ | 5 | | — | 0.75 | 0.81 | 0.48 | — |
| AGA | $D^c/H_2O$ | 5 | 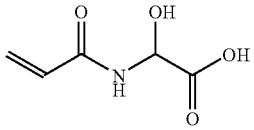 | — | 0.80 | 0.80 | — | — |
| SPE | $D^c/H_2O$ | 5 | 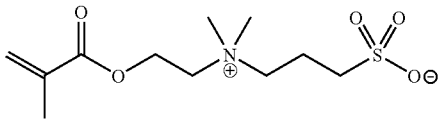 | — | 0.87 | 0.62 | 0.59 | — |
| META | $B^c/H_2O$ | 5 | 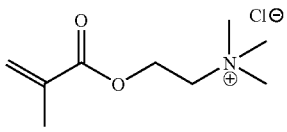 | — | 0.63 | 0.52 | — | — |
| DPMA | A/acetone | 5 | 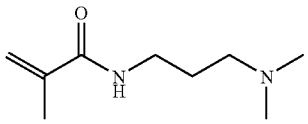 | — | 0.17 | 0.11 | — | — |
| | $B^c$/acetone | 5 | | — | 0.58 | 0.48 | — | — |
| VAL | A/acetone | 5 | 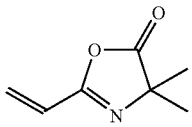 | — | 0.22 | 0.16 | — | — |
| | F/acetone | | | — | 0.40 | 0.39 | — | — |
| HFBA | A/HFP | 5 | 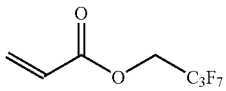 | — | 1.06 | — | — | 1.21 |

TABLE 4-continued

Photografting of COC with various monomers

| Monomer | Conditions/ Extraction | Irrad[a] | Structure | R | Grafting efficiency[b] O | N | S | F |
|---|---|---|---|---|---|---|---|---|
| PFOA | A/HFP | 5 | 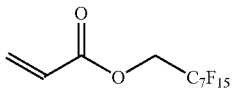 | — | 1.16 | — | — | 1.33 |
| PFPA | A/HFP | 5 | 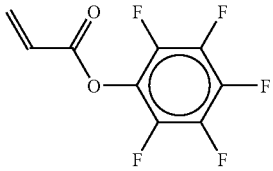 | — | 0.33 | — | — | 0.32 |

[a]Irradiation time, min.
[b]Calculated for each element as the ratio (X/C found)/(X/C theoretical) for X = O, N, S, or F.
[c]Remains emulsion The contact angles and grafting efficiencies for COC after irradiation through either bulk MA (Procedure A of Table 1) or an aqueous solution of AMPS (Procedure B of Table 1) for 5 min in a chamber fitted with several PE gaskets having thicknesses of 25, 50, 100, and 200 μm were measured. The self-screening effect of MA is significant as the grafting efficiency decreases from 84% for the lowest grafted polymer layer thickness to 31% for a layer 200 μm thick. The measured contact angles correlate well with this finding. Some grafting is possible to achieve in the presence of 3 wt % of benzophenone even through a 200 μm layer of the bulk MA.

EXAMPLE 5

Effect of Channel Depth on Photografting Thermoplastic Polymers

The extent of this polymerization in solution can be reduced by diluting the monomer with a suitable solvent. Dilution with a solvent that has lower absorbancy in the UV range than the monomer itself also helps to reduce the negative self-screening effect of the monomer. This is confirmed by the considerably smaller effect of layer thickness observed during the grafting process carried out with a 30 wt % aqueous solution AMPS. The grafting efficiency based on XPS data monitoring the abundance of sulfur showed only a moderate decrease from 0.66 to 0.48 upon increasing the gasket thickness from 0 to 200 μm.

EXAMPLE 6

Photografting Copolymers on COC

Model grafting experiments with spin coated COC were performed using a mixture of hydrophobic BuA and ionizable AMPS (Table 1E) with an irradiation time of 5 min. Since AMPS also contains sulfur, its incorporation in the copolymers is readily estimated from XPS spectra using the S/C or S/O atomic ratios. Table 5 summarizes the results of copolymerizations obtained upon varying the composition of the monomer mixture.

TABLE 5

Preparation of photografted AMPS and nBuA copolymers.

| $f_{AMPS}$, wt[a] | $f_{AMPS}$, mol[a] | S/C | S/O |
|---|---|---|---|
| 1.00 | 1.00 | 0.084 | 0.17 |
| 0.85 | 0.93 | 0.064 | 0.15 |
| 0.74 | 0.82 | 0.042 | 0.12 |
| 0.50 | 0.62 | 0.015 | 0.06 |
| 0.20 | 0.29 | 0.003 | 0.01 |
| 0.04 | 0.06 | 0.00 | 0.00 |
| 0.00 | 0.00 | 0.00 | 0.00 |

[a]Fraction of AMPS in monomer mixture

EXAMPLE 7

Photografting Grafted Polymer Layers on Thermoplastic Polymers

Figure 5:
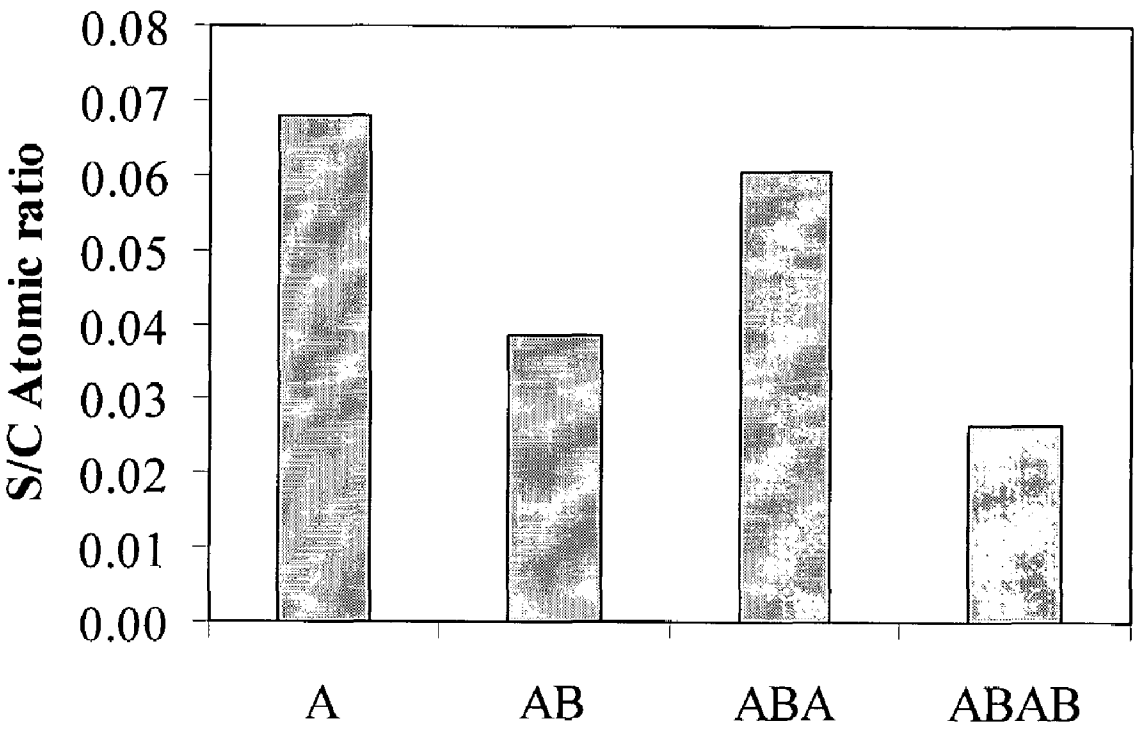
FIG. 5 is chart showing the S/C atomic ratio for subsequently grafted 'block-like' layers using 2-acryamido-2-methylpropanesulfonic acid (A) and butyl acrylate (B).

FIG. 5 is a bar chart showing different sulfur/carbon atomic rations with different layers of grafting monomer. Alternating layers of AMPS (A) and BuA (B) (Table 5E) were photografted for 5 min on spincoated COC. Since the thickness of the grafted polymer layers is less than the sampling depth of XPS, sulfur is detected in each layer. However, its content is significantly higher when polyAMPS forms the top layer (FIG. 5, A and ABA). Swelling of the previously prepared polymer layer in the subsequent monomer mixture also contributes to a decreased sharpness of the boundary at the interface of the two polymer layers.

This Example further confirms that the number of grafted polymer layers is not limited to one or two. Although demonstrated with only two different monomers, it is conceivable to have multiple layers, e.g. four, each from a different polymer.

EXAMPLE 8

Photografting Patterns of Grafting Monomers on Thermoplastic Polymers

Figure 6:
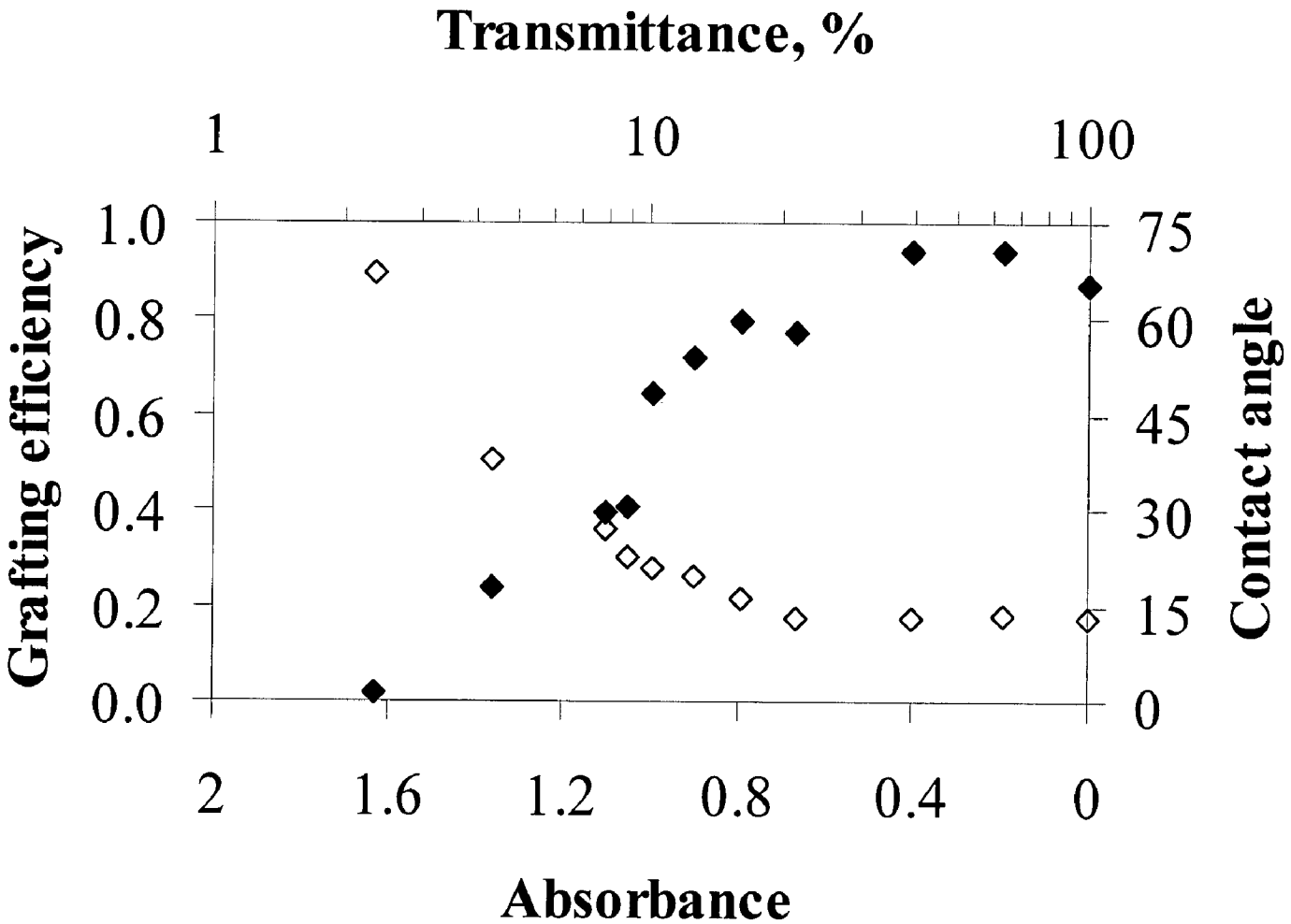
FIG. 6 is a graph showing grafting efficiency determined from S/C ratio (◆) and contact angle (◇) of COC surface grafted with 2-acryamido-2-methylpropanesulfonic acid for 5 min using irradiation through a multi density mask.

FIG. 6 illustrates the effect of irradiation through a step-gradient mask on the grafting efficiency of AMPS and the contact angle of the surface (Table 1, E, 5 min irradiation). Grafting efficiency was determined from S/C ratio (♦) and contact angle (◇) for 2-acryamido-2-methylpropanesulfonic acid (AMPS) grafted for 5 min using irradiation through a multi density target mask that consist of fields differing in density and therefore transparency for UV light. The absorbance values of the fields of the multi density target varied between 0.2-1.6. The values obtained for each field were normalized with respect to the grafting in systems containing only a quartz plate with an absorbance value of zero. As expected, the grafting efficiency increases linearly with decreasing absorbance until it reaches the point at which the grafted layer thickness exceeds the depth of information of XPS, and then levels out. The contact angle values confirm the trends obtained for the grafting efficiencies. The higher the extent of the grafting, the lower the contact angle.

EXAMPLE 9

Covalently Bonding the Porous Polymer Monolith to a Thermoplastic Channel

This example demonstrates the concept of monolith attachment to thermoplastic channels. First, this was demonstrated using tubes from a readily available polyolefin, PP. The inner surface of PP tubes was grafted with ethylene diacrylate and then a porous poly(methyl methacrylate-co-ethylene dimethacrylate) monolith was prepared inside these tubes.

The tube with an i.d. of 800 μm was filled to a height of about 5 mm with the bulk monomer, ethylene diacrylate (EDA) or a 1:1 mixture of this monomer with methyl acrylate (MA) using capillary action and irradiated from a distance of 25 cm for 3 min. Once the reaction was complete, the tubes were washed with acetone, extracted in the same solvent for 12 hours, and dried in a vacuum oven at room temperature for 24 hours.

The surface modified tubes were filled again by capillary action to a height of about 5 mm with the nitrogen purged monomer mixture consisting of HEMA (24 wt %), EDMA (16 wt %), 1-dodecanol (29 wt %), cyclohexanol (31 wt %) and DMPAP (1 wt % with respect to monomers) to form porous polymer monoliths and irradiated from a distance of 25 cm for 20 min. The monoliths were then extracted in three portions of methanol for 24 hours, and dried in a vacuum oven at 40° C. for 12 hours.

Scanning electron microscpe images (not shown) were taken of the inner surface of 2.5 mm long samples cut from the tube after removal of the polymer monolith. The absence of surface treatment resulted in no bonding. Large voids were observed between the polymer matrix and the PP tube resulting both from shrinkage during polymerization and the subsequent drying. The monolith was able to slip out of the tube without applying any force.

The grafting time for a 1:1 mixture of EDA and MA was extended to 3 min. This approach affords good binding to the PP surface as also confirmed by the difficulty encountered in trying to remove the monolith from the tube. The monovinyl monomer, methyl acrylate, used in the grafting solution decreases the crosslinking density of the grafted surface layer and enables it to swell within the polymerization mixture used for the preparation of the monolith.

Best results were obtained after grafting with a 1:1 mixture of EDMA and MMA. Since grafting of methacrylates is slower that that of acrylates, this approach extends the period of irradiation time to 12 min. Once again, the HEMA/EDMA monolith filled the cross section of the tube completely and no void between the monolith and the tube was observed. Its removal from the tube proved to be very difficult. The features at the inner surface after removal of the monolith were similar to those observed when the grafting time was 3 min using a 1:1 mixture of EDA and MA. However, the skin of globular polymer remaining in the tube after polymer monolith removal was significantly thicker, which correlates well with the longer grafting time, and indicates that excellent covalent binding of the monolith to PP has been achieved. Further refining of this procedure, if required, could be achieved by varying the type of the comonomer, irradiation time, and by the addition of a solvent.

A porous polymer monolith can also be covalently bonded to surface modified channels of a COC microchip. The channels of the COC microchips were filled with a mixture of ethylene diacrylate (EDA) and methyl methacrylate (MMA) (1:1 mixture) and the surface pretreated by photografting for 10.5 minutes followed by rinsing with methanol for 2 hours.

The channels of the COC microchips were then filled with the monomer mixture consisting of BuMA (24 wt %), EDMA (16 wt %), 1-decanol (60 wt %) and DMPAP (1 wt % with respect to monomers), previously purged with nitrogen, to form porous polymer monoliths within the channels of the COC microchip. The sections of the microchip that should not contain the monolith were covered with a photomask, consisting of black electrical tape, and the microchip was irradiated from a distance of 30 cm for 3 minutes. The monolith in the channel was washed with methanol pumped through at a flow rate of 0.10 μL/min for 12 hours. The micrograph taken (not shown) of a high magnification view of the top of the monolith, clearly shows the monolith is attached to the COC wall. Indeed, no movement or loss of adhesion of the monolith was observed when a pressure of 1.4 MPa was applied during its washing with methanol using pressurized flow.

EXAMPLE 10

Preparation of Grafted Porous Polymer Monoliths in Fused Silica Capillaries

In order to demonstrate photografting of a porous polymer monolith unaffected by the materials of the plastic device and its photografted coating, the following experiments were carried out in fused TEFLON coated silica capillaries (50 or 100 μm i.d., Polymicro Technologies, Phoenix, Ariz.). The capillaries were rinsed with acetone and water using a syringe pump, activated with 0.2 mol/L sodium hydroxide for 30 min, washed with water, then with 0.2 mol/L HCl for 30 min, then with water again and finally with ethanol. A 20 wt % solution of 3-(trimethoxysilyl)propyl methacrylate in 95% ethanol with pH adjusted to 5 using acetic acid was pumped through the capillaries at a flow velocity of 1 mm/sec for 1 h, washed with ethanol, dried in a stream of nitrogen, and left at room temperature for 24 h. The 40 cm long surface modified capillary was filled with monomer solution I or II, as described in Table 6, by capillary action to a length of 10.5 cm, placed under the light source, and irradiated with UV for 10 min at a distance of 30 cm. The porous polymer monolith in the capillary was washed with methanol pumped through at a flow velocity of 1 mm/sec for 12 h.

TABLE 6

Compositions of polymerization mixtures used for the preparation of porous polymer monoliths

| | Monoliths series | |
|---|---|---|
| | I | II |
| Butyl methacrylate, wt % | 24 | 24 |
| Ethylene dimethacrylate, wt % | 16 | 16 |
| 1-Decanol, wt % | x [b] | x [b] |
| Cyclohexanol, wt % | 60-x | — |
| 1,4-Butanediol, wt % | — | 60-x |
| DMAP, wt % [a] | 1 | 1 |

[a] Percentage of 2,2-dimethoxy-2-phenylacetophenone with respect to monomers.
[b] Percentage of 1-decanol was varied in a range of 20-60 wt %.

Next, a 50 or 100 μm i.d. Teflon coated fused silica capillary containing a porous monolith was filled with the deaerated monomer solution A or B shown in Table 7 by pumping at a flow velocity of 1 mm/s for 30 min. Grafting was achieved by irradiation through a mask from a distance of 25 cm for a specific period of time. The capillary was then washed with water at a flow velocity of about 1 mm/s for 12 h, and another 2 h with a 80:20 mixture of acetonitrile and 5 mmol/L phosphate buffer pH 7.

Table 7 shows reaction mixtures used for photografting of monoliths with 2-acrylamido-2-methyl-1-propanesulfonic acid (AMPS) and 4,4-dimethyl-2-vinylazlactone (VAL).

TABLE 7

Reaction mixtures used for photografting of monoliths.

| Mixture | Solvent | Monomer, wt % | | Initiator, | Pluronic |
|---|---|---|---|---|---|
| | | AMPS | VAL | wt %[a] | F-68, wt % |
| A | $H_2O$ | 15 | — | 0.02 | 0.34 |
| B | tBuOH—$H_2O$ 3:1 | 15 | — | 0.22 | — |
| C | tBuOH | — | 15 | 0.22 | — |

[a]Concentration of benzophenone in solution

The deaerated monomer solution C shown in Table 7 was pumped through a 50 μm i.d. Teflon coated fused silica capillary containing the porous monolith at a flow velocity of 1 mm/s for 30 min. The photomask was made from stripes of adhesive black tape attached to a borofloat glass wafer (100 mm×1.1 mm, Precision Glass & Optics, Santa Ana, Calif.). The capillary filled with the polymerization mixture was placed under the light source, covered with the mask, and irradiated from a distance of 30 cm for a specific period of time. After the grafting was completed, the capillary was washed by acetone at a flow velocity of 1 mm/s for 12 hours.

Monoliths with a pore size of 1.5 μm prepared within a 100 μm i.d. fused silica capillaries from polymerization mixture of II series (Table 6) containing butanediol were selected for grafting with AMPS. A clear solution of benzophenone (photoinitiator) in water was obtained only for initiator concentrations of up to 0.02%. Experiments with this solution (Table 7, mixture A) afforded very reproducible results.

The continuous increase in the flow resistance measured as the back pressure of water pumped through the monolith with the grafting time is a good indication that the thickness of the grafted layer increases. A very high back pressure of 33 MPa was observed for a monolith of only 8.5 cm long after a grafting time of 2 min that made pumping solvents through the monolith and washing the pores very difficult. As a result, grafting for any longer times was not attempted using this approach. However, despite these extremely high pressures, no physical damage or dislocation of the monolith was observed, thus confirming its high mechanical stability and firm attachment to the wall. In contrast, a monolith grafted with AMPS for 1 min affords permeable monoliths and allows washing at a tolerable back pressure.

A more crosslinked and less swellable polyAMPS layer can be grafted in 75% solution of tBuOH in water (Table 7, mixture B). As a result, the maximum of the back pressure in the system is reached after about 1 min grafting and does not change much thereafter. For example, the monolith grafted for 10 min under these conditions exhibits a back pressure of only 2.8 MPa. The back pressure of 23 MPa was observed for water pumped through the monolith grafted for 60 s at a low flow rate of 0.1 μl/min, while only 14 and 0.2 MPa was found for methanol and acetone, respectively, at a five times higher flow rate of 0.5 μl/min. These solvents do not swell polyAMPS grafts to the extent characteristic of water, the pores are less clogged, and the back pressure is lower. For comparison, the flow resistance of the original monolith without grafting under equal conditions is in the range of 0.2-0.3 MPa for all three solvents.

The effect of grafting time on electroosmotic flow (EOF) for monoliths grafted with 2-acrylamido-2-methyl-1-propanesulfonic acid in water (Mixture A, Table 7) and in t-butanol/water (Mixture B, Table 7) was determined. Using conditions A (Table 7), EOF increases to $45\times10^{-9}$ $m^2/Vs$ within 1 minute of grafting of Mixture B, and within 2 minutes for Mixture A.

EXAMPLE 11

Figure 7:
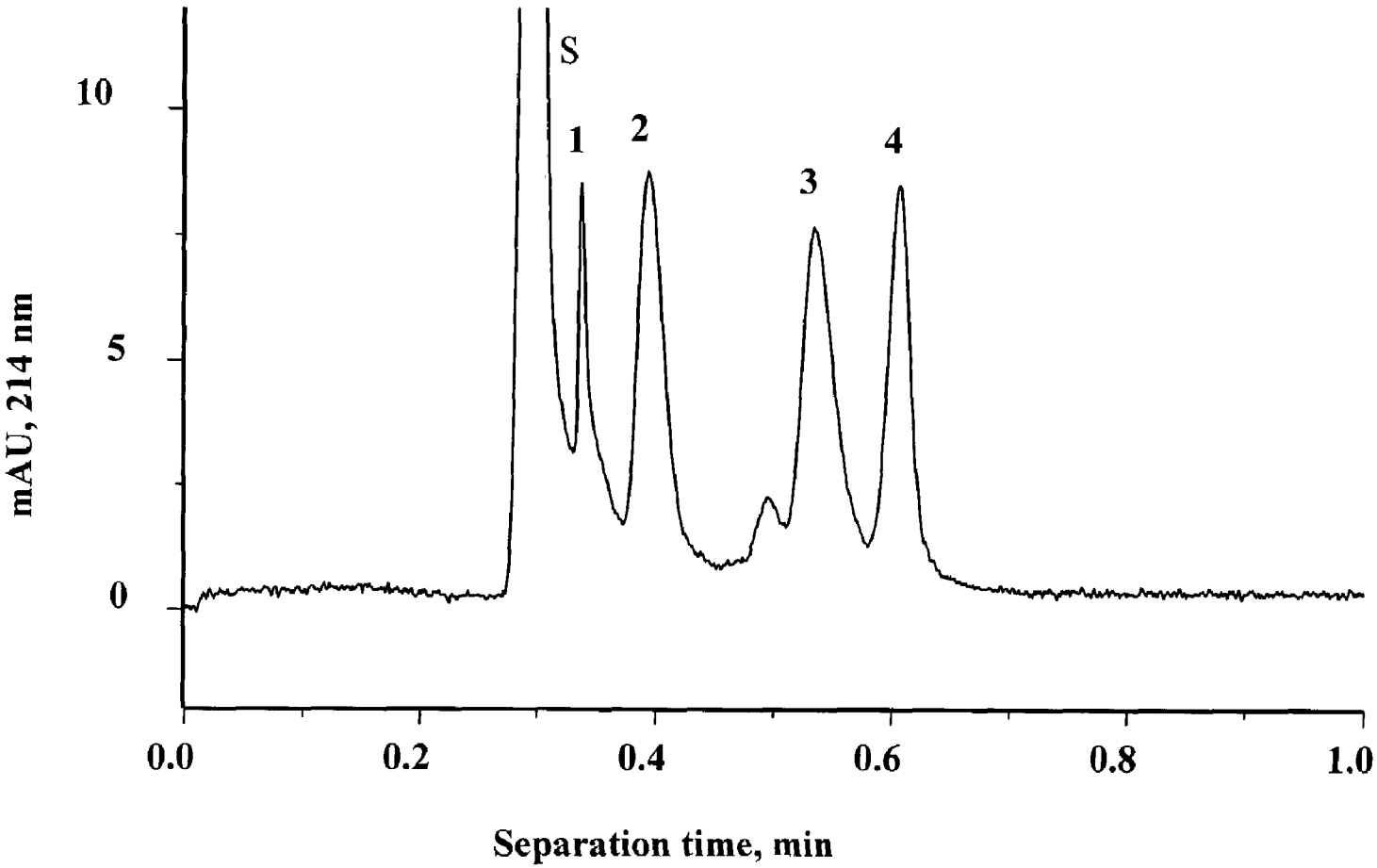
FIG. 7 is a chromatogram showing the separation of peptides at peaks 1-4 using a monolithic capillary grafted with 2-acrylamido-2-methyl-1-propanesulfonic acid, in less than 1 min.

Capillary Electric Chromatography (CEC) Separation of Peptides using Photografted Porous Polymer Monolith FIG. 7 is a chromatogram showing the separation of peptides in capillary electrochromatographic mode using the HEMA/EDMA monolithic capillary of Example 10 grafted with AMPS. Separation of peptides was achieved using a monolithic capillary grafted with 2-acrylamido-2-methyl-1-propanesulfonic acid, using the following conditions: capillary column total length 34.5 cm, monolith 8.5 cm, 30 s grafting; mobile phase 100 mmol/L NaCl solution in 10 mmol/L phosphate buffer pH 6.0; voltage −15 kV; overpressure in both vials 0.8 MPa; temperature 60° C.; concentration of peptides 0.1 mg/mL; pressure driven injection at 0.8 MPa for 0.05 min. Peaks: system peak (S), Gly-Tyr (1), Val-Tyr-Val (2), methionine enkephalin (3), leucine enkephalin (4).

This isocratic separation is unusually fast and all four peptides are well separated in less than 1 min. This chromatogram clearly demonstrates the high magnitude of the electroosmotic flow driven by grafted AMPS chains that is about three times as high as that observed for silica-based packings developed specifically for CEC. This can be again attributed to the large number of accessible ionized functionalities located on the surface of the pores.

EXAMPLE 12

Patterning Functionalities in Porous Monoliths Using Grafting Methods

The additional benefit of photografting is the ability to create patterns differing in properties such as surface coverage or even type of the grafted chemistry. This is demonstrated by grafting 4,4-dimethyl-2-vinylazlactone (VAL) through a mask on a several cm long poly(butyl methacrylate-co-ethylene dimethacrylate) PBuMA-EDMA monolith with a pore size of 1.5 μm located inside of a 50 μm i.d. capillary. The mask created on a Borofloat glass wafer leaves open 1 mm long windows separated by 1 mm long covered areas along the capillary axis. The monolith was then irradiated for either 1 minute or 3 minutes to compare the amount of grafting time needed to allow the VAL groups to react with Rhodamine 6G to create a pattern. Reactive functionalities of the grafted VAL chains were allowed to react with Rhodamine 6G (Molecular Probes, Eugene, Oreg.) via its secondary amino groups. Immobilization of this fluorescent dye enables visualization of the grafts using an optical microscope in the fluorescent mode.

A 0.02 mmol/L Rhodamine 6G in a standard coupling solution containing 0.5 mol/L sodium sulfate, 0.1 mol/L sodium carbonate, and 0.05 mol/L benzamidine in water was prepared, filtered, and pumped through the capillaries for 4 h at 0.25 μL/min. The capillaries were then washed with a 3:1 methanol-10 mmol/L borate buffer solution pH=9.2 mixture for 12 h to remove the unreacted fluorescent dye.

The fluorescence microscope images of the monolith that was grafted with VAL for 1 and 3 min used for separation of peptides showed selected immobilization of the reacted Rhodamine 6G in the discreet 1 mm long stretches as delineated by the mask. This demonstrates the usefulness of grafted VAL at preselected regions in the separation of amine-reactive compounds, such as peptides.

EXAMPLE 13

Experimental Methods and Characterization of the Photografting Process

Light source. An Oriel deep UV illumination system series 8700 (Stratford, Conn.) fitted with a 500 W HgXe-lamp was used for UV exposure. The irradiation power was calibrated to 15.0 mW/cm$^2$ using an OAI Model 354 exposure monitor (Milpitas, Calif.) with a 260 nm probe head. The emission spectrum of the exposed light was recorded with a UV-Raman spectrometer.

Characterization methods. UV transmission spectra were recorded using a Varian Cary 50 Conc UV-visible spectrometer (Lexington, Mass.). Contact angle measurements were performed using a Krüss contact angle measuring system G10 (Charlotte, N.C.). Contact angles were taken in the static mode, 2 min after the application of the droplet. X-ray photoemission spectroscopy (XPS) was performed with a Physical Electronics PHI 5400 ESCA, equipped with an Omni II small spot lens, using an Al anode x-ray source.

EXAMPLE 14

Characterization Methods for Photografting Monoliths

Porosity measurements. Since the weight of monoliths prepared in the capillaries are not sufficient for porosimetry measurement, we mimiced the conditions using bulk polymerization in a mold that had a larger volume. This mold consisted of a circular Teflon plate and a quartz wafer (100× 1.6 mm, Chemglass, Vineland, N.J.) separated by a 700 μm thick polysiloxane gasket sandwiched between an aluminum base plate and a top aluminum ring held together with 8 screws. The mold was filled with the polymerization mixtures (Table 1), deaerated by purging nitrogen for 10 min, and irradiated through the quartz window for 20 min. After the polymerization was completed, the mold was opened, the solid polymer recovered, broken into smaller pieces, extracted in a Soxhlet apparatus with methanol for 12 h, and dried in vacuum at 60° C. for 12 h. The pore size distributions of the monolithic materials were determined using an Autopore III 9400 mercury intrusion porosimeter (Micromeritics, Norcross, Ga.).

Electrochromatography. Capillary electrochromatographic experiments were carried out using an Agilent$^{3D}$ CE system (Agilent Technologies, Waldbronn, Germany) equipped with a diode array detector and an external pressurization system. An equal helium pressure of 0.8 MPa was applied at both ends of the capillary column. The mobile phase was prepared from phosphoric acid, which pH was adjusted to 6.0 using aqueous sodium hydroxide and then diluted to the desired concentration with a mixture of water and acetonitrile. The sample solutions (0.5 mg/mL) were injected using pressure of 0.8 MPa for 3 s, and the separations performed at a voltage of −15 kV while the cassette compartment temperature was adjusted to 25° C. Acetone was used as an EOF marker.

The present examples, methods, procedures, treatments, specific compounds and molecules are meant to exemplify and illustrate the invention and should in no way be seen as limiting the scope of the invention. Any patents or publications mentioned in this specification are indicative of levels of those skilled in the art to which the patent pertains and are hereby incorporated by reference to the same extent as if each was specifically and individually incorporated by reference.

What is claimed is:

1. A microfluidic device, comprising:

(a) at least one channel for conducting a fluid, said channel having an internal channel surface formed in a substrate;

(b) a first polymer attached to the channel surface through photoinitiated grafting of a first monomer to selected regions of the channel surface;

(c) a porous polymer monolith, comprising a second monomer attached to said first polymer in the selected regions in said channel through photoinitated grafting thereby bonding the monolith to the channel surface, wherein the first and second monomers may be the same or different; and (d) a polymer chain comprising a third monomer having a functional group, wherein said polymer chain is attached to a portion of the porous polymer monolith by photoinitiated grafting of said third monomer, wherein the third monomer is different from the second monomer.

2. The device of claim 1 wherein said substrate is thermoplastic and transparent to light in the wavelength range of 200 to 350 nm.

3. The device of claim 2 wherein the thermoplastic substrate is selected from the group consisting of poly(methyl methacrylate), poly(butyl methacrylate), poly(dimethylsiloxane), polyolefin, cyclic olefin copolymer, polyethylene, polypropylene, poly(ethylene terephthalate), poly(butylene terephthalate), polyimide and hydrogenated polystyrene.

4. The device of claim 2 wherein the porous polymer monolith is comprised of a mixture of monomers selected from the group consisting of HEMA, EDMA and BuMA.

5. The device of claim 1 wherein said thermoplastic substrate is a polyolefin.

6. The device of claim 5 wherein the thermoplastic substrate polyolefin is cyclic olefin copolymer.

7. The device of claim 1 wherein the substrate is selected from the group consisting of PS-H, COC and PP.

8. The device of claim 1 wherein the channel is 10-200 μm deep.

9. The device of claim 1 wherein the first polymer attached to the channel surface for grafting is comprised of one or more monomers selected from the group consisting of a polyvinyl monomer, a monovinyl monomer, and a mixture of a polyvinyl and monovinyl monomer.

10. The device of claim 9 wherein said one or more monomer is a monovinyl monomer which is selected from the group consisting of acrylic acids, methacrylic acids, acrylamides, methacrylamide alkyl derivatives of methacrylamide, alkyl derivatives of acrylamide, alkyl acrylates, alkyl methacrylates, perfluorinated alkyl acrylates, perfluorinated alkyl methacrylates, hydroxyalkyl acrylates and hydroxyalkyl methacrylates, wherein the alkyl group in each of the aforementioned alkyl monomers has 1-10 carbon atoms, oligoethyleneoxide acrylates, oligoethyleneoxide methacrylates, vinylazlactones, and acrylate and methacrylate derivatives including primary, secondary, tertiary, and quartemary amine functionalities and zwitterionic functionalities.

11. The device of claim 9 wherein said one or more monomer is a polyvinyl monomer which is selected from the group consisting of alkylene diacrylates, alkyl dimethacrylates alkylene diacrylamides, alkylene dimethacrylamides, hydroxyalkylene diacrylates, hydroxyalkylene dimethacrylates, wherein the alkylene group in each of the aforementioned alkylene monomers consists of 1-6 carbon atoms, oligoethylene glycol diacrylates, oligoethylene glycol dimethacrylates, vinyl esters of polycarboxylic acids, divinyl ethers, pentaerythritol di-, tri-, or tetramethacrylates, pentaerythritol di-, tri-, or tetraacrylates, trimethylopropane trimethacrylates, trimethylopropane acrylates, alkylene bis acrylamides and alkylene methacrylamides.

12. The device of claim 1 wherein the first polymer attached to the channel surface for grafting is comprised of at least one monomer selected from the group consisting of AAm, BuA, AMPS, EDA, EDMA, MMA and MA.

13. The device of claim 1 wherein the porous polymer monolith is comprised of one or more polymerized monomers selected from the group consisting of polyvinyl monomers or a mixture of polyvinyl and monovinyl monomers.

14. The device of claim 13 wherein said one or more monomer for the monolith is a polyvinyl monomer which is selected from the group consisting of alkylene diacrylates, alkylene dimethacrylates, hydroxyalkylene diacrylates, hydroxyalkylene dimethacrylates, alkylene bisacrylamides, alkylene bismethacrylamides, wherein the alkylene group each of the aforementioned alkylene monomers has 1-6 carbon atoms, oligoethylene glycol diacrylates, oligoethylene dimethacrylates, diallyl esters of polycarboxylic acids, divinyl ethers, pentaerythritol di-, tri-, or tetraacrylates, pentaerythritol di-, tri-, or tetra methacrylates, trimethylopropane triacrylates and trimethylopropane trimethacrylates.

15. The device of claim 13 wherein said one or more monomer for the monolith is a monovinyl monomer which is selected from the group consisting of acrylic acids, methacrylic acids, acrylamides, methacrylamide alkyl derivatives of methacrylamide, alkyl derivatives of acrylamide, alkyl acrylates, alkyl methacrylates, perfluorinated alkyl acrylates, perfluorinated alkyl methacrylates, hydroxyalkyl acrylates and hydroxyalkyl methacrylates, wherein the alkyl group in each of the aforementioned alkyl monomers has 1-10 carbon atoms, oligoethyleneoxide acrylates, oligoethyleneoxide methacrylates, vinylazlactones, and acrylate and methacrylate derivatives including primary, secondary, tertiary, and quartemary amine functionalities and zwitterionic functionalities.

16. The device of claim 1 wherein the third monomer bearing the functional group is selected from the group consisting of: acrylic acids, methacrylic acids, acrylamides, methacrylamides, alkyl acrylamides, alkyl methacrylamides, alkyl acrylates, alkyl methacrylates, perfluorinated alkyl acrylates, perfluorinated alkyl methacrylates, hydroxyalkyl acrylates, hydroxyalkyl methacrylates, wherein the alkyl group each of the aforementioned alkyl monomers has 1-10 carbon atoms, vinylazlactones, oligoethyleneoxide acrylates, oligoethyleneoxide methacrylates, and acrylate and methacrylate derivatives wherein the derivatives comprise a primary, secondary, tertiary or quartemary amine or a zwitterion.

17. The device of claim 1 wherein the third monomer bearing the functional group is selected from the group consisting of: methyl acrylate, methyl methacrylate, butyl acrylate, butyl methacrylate, tert-butyl acrylate, tert-butyl methacrylate, 2-hydroxyethyl acrylate, 2-hydroxyethyl methacrylate, acrylic acid, methacrylic acid, glycidyl acrylate, glycidyl methacrylate, 3 -sulfopropyl acrylate, 3 -sulfopropyl methacrylate, pentafluorophenyl acrylate, pentafluorophenyl methacrylate, 2,2,3,3,4,4 ,4-heptafluorobutyl acrylate, 2,2,3,3,4,4,4-heptafluorobutyl methacrylate, 1H,1H-perfluorooctyl acrylate, 1H,1H-perfluorooctyl methacrylate, acrylamide, methacrylamide, N-ethylacrylamide, N-isopropylacrylamide, N- [3-(dimethylamino) propyl] methacrylamide, 2-acrylamido-2-methyl- 1 -propanesulfonic acid, 2-acrylamidoglycolic acid, [2-(methacryloyloxy)ethyl]-trimethylammonium chloride, [2-(methacryloyloxy) ethyl] dimethyl(3 -sulfopropyl)ammonium hydroxide, and 2-vinyl-4,4-dimethyl-azlactone.

18. The device of claim 1 wherein the third monomer is selected from the group consisting of AMPS, BuA and VAL.

19. A microfluidic device, comprising:

(a) at least one channel for conducting a fluid, said channel having an internal channel surface formed in a substrate comprising a polyolefin;

(b) a first polymer, comprised of a first polyvinyl monomer, attached to the channel surface through photoinitiated grafting to selected regions of the channel surface; and (c) a porous polymer monolith, comprised of a second polyvinyl monomer attached to said first polymer in the selected regions in said channel through photoinitiated grafting thereby bonding the monolith to the channel surface, wherein the first and second monomers may be the same or different; and (d) a polymer chain having a functional group attached to a portion of the porous polymer monolith by photoinitiated grafting of a third monomer, wherein the third monomer is different from the second monomer.

20. The device of claim 19 wherein the third monomer is an acrylate.

* * * * *